US005429322A

United States Patent [19]

Waymeyer

[11] Patent Number: 5,429,322

[45] Date of Patent: Jul. 4, 1995

[54] ADVANCED HOMING GUIDANCE SYSTEM AND METHOD

[75] Inventor: Walter K. Waymeyer, La Verne, Calif.

[73] Assignee: Hughes Missile Systems Company, Los Angeles, Calif.

[21] Appl. No.: 231,084

[22] Filed: Apr. 22, 1994

[51] Int. Cl.[6] ..... F41G 7/00

[52] U.S. Cl. ..... 244/3.15; 364/424.01

[58] Field of Search ..... 244/3.15; 364/424.01

[56] References Cited

U.S. PATENT DOCUMENTS

| | | | |
|---|---|---|---|
| 4,456,862 | 6/1984 | Yueh | 318/561 |
| 4,492,352 | 1/1985 | Yueh | 244/3.15 |
| 4,494,202 | 1/1985 | Yueh | 364/462 |
| 4,502,650 | 3/1985 | Yueh | 244/3.15 |

*Primary Examiner*—Charles T. Jordan
*Assistant Examiner*—Christopher Keith Montgomery
*Attorney, Agent, or Firm*—Charles D. Brown; Randall M. Heald; Wanda K. Denson-Low

[57] ABSTRACT

A guidance system for directing a vehicle toward a target which includes a measurement processing section, a target state estimator, and a command processing section. The measurement processing section determines the inertial orientation and length of a line-of-sight vector which conceptually connects the vehicle with the target from measurements taken by a plurality of sensors. The target state estimator provides an estimation of the speed and angular aspect of the target relative to line-of-sight vector, by relating the vehicle and the target to each other through a mechanical conceptualization. This mechanical conceptualization treats the line-of-sight as a collapsible rod which is connected at one end through a mechanical gimbal set, and connected at the other end through a universal joint with four degrees of freedom. The command processing section generates command signals for the autopilot of the vehicle. These command signals seek to minimize the angular difference between the relative velocity vector of the vehicle with respect to the target and the line-of-sight vector to the target.

21 Claims, 10 Drawing Sheets

CONCEPTUALIZATION OF PHYSICAL RELATIONSHIPS BETWEEN THE MISSILE VELOCITY AND ATTITUDE, AND THE TARGET VELOCITY VECTOR.

CONCEPTUALIZATION OF PHYSICAL RELATIONSHIPS BETWEEN THE MISSILE VELOCITY AND ATTITUDE, AND THE TARGET VELOCITY VECTOR.

SM sigrec ESTIMATOR, FED BY MISSILE AND SEEKER MEASURED RATES AND GIMBAL ANGLES MEASURED BY POTENTIOMETERS

SM BETA AND BETADOT ESTIMATOR, USING MEASURED RATES AND ANGLES (ESTIMATES betaa AND betab FOR MISSILE STATE RESOLUTION AND betabd AND betaad)

ADVANCED HOMING GUIDANCE SYSTEM AND METHOD

BACKGROUND OF THE INVENTION

The present invention generally relates to flight guidance and control systems for intercepting air or space crafts, and particularly to an advanced guidance system and method for homing missiles that provide improved performance in the terminal phase near target intercept.

Previous guidance systems were founded on basic and improved Proportional Navigation. In this regard, the U.S. Pat. Nos. 4,456,862, 4,492,352, 4,494,202, and 4,502,650 to William R. Yueh provide a good example of a terminal guidance system for missiles which employs improved proportional navigation techniques. Nevertheless, previous guidance systems have generally not given detailed attention to the stability of the control system in the last moments before intercept. More specifically, in most previous homing guidance laws, there is a built-in instability near intercept that causes a miss when disturbances occur (e.g., new information or new target maneuvers or terminal area sensor or target generated noise) after the system is nearing instability. As a result, these control systems have gone into the 'end game' in a marginally stable or unstable condition. Any transient input to the control system can increase the probability of causing the beginning of a divergent oscillation, which in turn, could cause a miss at intercept.

Additionally, previous guidance and control systems have tended to design the 'autopilot' and the 'guidance' system independently, and have failed to consider all of the destabilizing influences of the autopilot saturation nonlinearities on the entire guidance and control system. Often, this has resulted in a more conservative design than was necessary, and as indicated above, a design in which the control system was unstable at intercept. As a result, there is a general rule of thumb that the control system must have about ten missile time constants to go at terminal sensor acquisition, and establishes the fact of system miss when the target maneuvers within ten, or so, time constants to go. It is also traditional that the missile acceleration capability should be three times the target acceleration capability.

Accordingly, it is a principal objective of the present invention to provide an advanced homing guidance system and method for directing a vehicle toward a target which substantially enhances performance near target intercept, such as the ability to respond to late target maneuvers.

It is another objective of the present invention to provide an advanced homing guidance system and method which embodies a unique conceptual coordinate system that relates the target body axes to the vehicle body axes.

It is a further objective of the present invention to provide an advanced homing guidance system and method which incorporates non-linear estimation techniques that segregate the relative velocity state from the relative position state, and to make maximum use of the physical attributes of the homing vehicle (e.g., its actuation power, control effectiveness, and lifting effectiveness).

It is an additional objective of the present invention to provide an advanced homing guidance system and method which enables a reduction in the required time constants to go at terminal sensor acquisition to two or three.

It is yet another objective of the present invention to provide an advanced homing guidance system and method which enables a reduction in the vehicle acceleration capability required from three to as little as two times the target acceleration capability.

SUMMARY OF THE INVENTION

To achieve the foregoing objectives, the present invention provides a guidance system for directing a vehicle toward a target which includes a measurement processing section, a target state estimator, and a command processing section. The measurement processing section determines the inertial orientation and length of a line-of-sight vector which conceptually connects the vehicle with the target from measurements taken by a plurality of sensors. The target state estimator provides an estimation of the speed and angular aspect of the target, relative to the line-of-sight vector, by relating the vehicle and the target to each other through a mechanical conceptualization. This mechanical conceptualization treats the line-of-sight as a collapsible rod which is connected at one end through a mechanical gimbal set, and connected at the other end through a universal joint with four degrees of freedom. The command processing section generates command signals for the autopilot of the vehicle. These command signals seek to minimize the angular difference between the relative velocity vector of the vehicle with respect to the target and the line-of-sight vector to the target.

Additional features and advantages of the present invention will become more fully apparent from a reading of the detailed description of the preferred embodiment and the accompanying drawings in which:

DETAILED DESCRIPTION OF THE PREFERRED EMBODIMENTS

Figure 1:
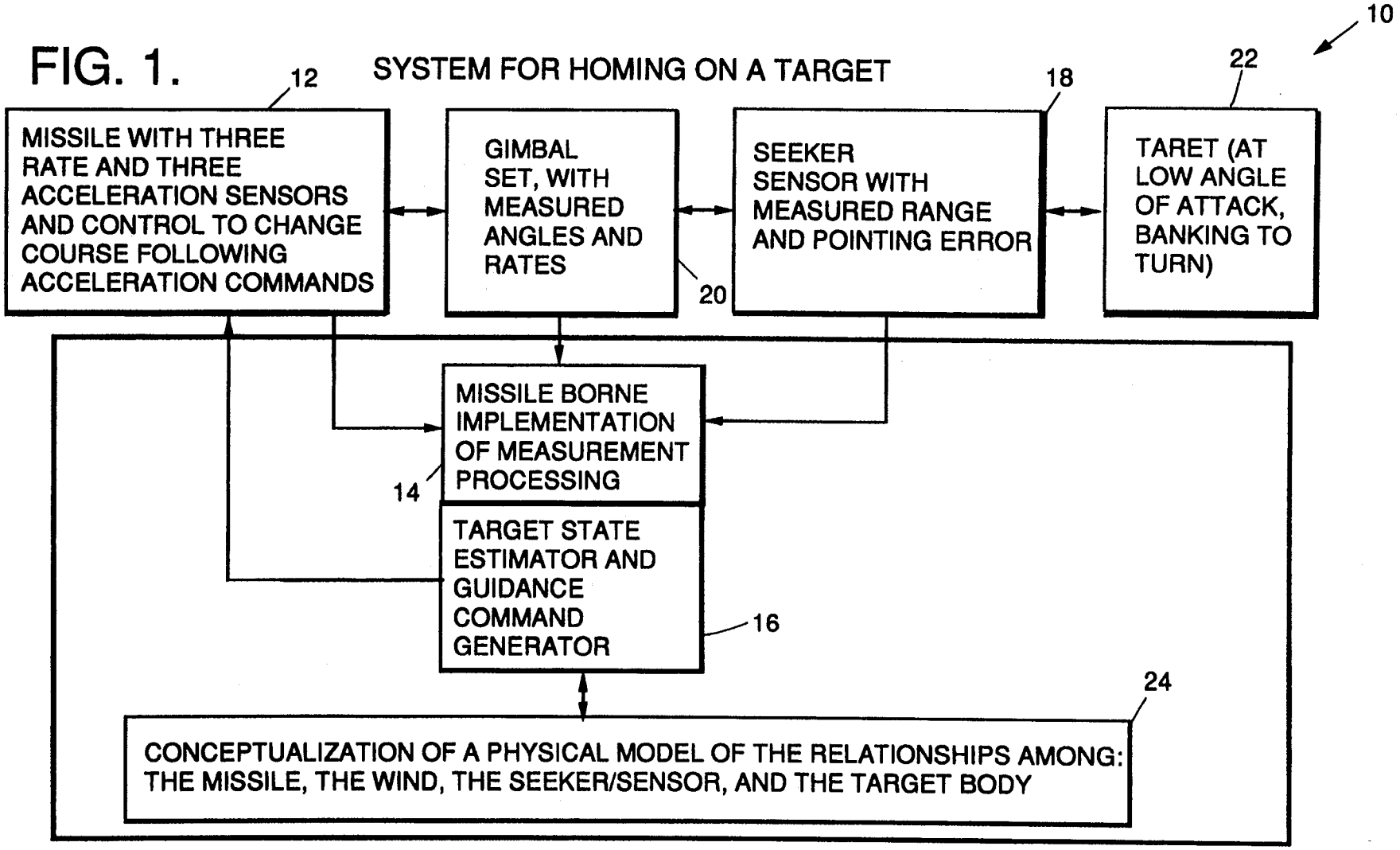
FIG. 1 is a block diagram of a system for homing a vehicle on a target in accordance with the present invention.

Referring to FIG. 1, a simplified block diagram of a system 10 for homing a vehicle on a target is shown. While the invention herein is described in the context of a missile which is homing on a target, it should be understood that the principles of the present invention may be applicable to other airborne or space vehicles and targets, as well as targets that are not necessarily evasive. A missile may be characterized by its velocity and its attitude with respect to the velocity. It has an acceleration or velocity-vector-turning-rate (gammadot) controller that responds to acceleration (or gammadot) commands. Its state is determinable from its known aerodynamic properties and the indications of the six inertial sensors on board (e.g., three accelerometers and three rate sensors). The combination of the on-board sensors and the gammadot controller are represented by block 12 in FIG. 1. These sensor measurements are transmitted to the missile-borne Measurement processing section 14. The results of computations in the missile-borne Measurement processing section 14 are then made available to the Target State Estimator and the Guidance Command Generator. The Target State Estimator and the Guidance Command Generator are represented in combination by block 16 in FIG. 1.

The missile and a target sensing device (e.g., a seeker sensor) 18 are connected mechanically (or by electronically scanned angle) through a real, or conceptual, gimbal set 20, so that the angles from the missile body to the sensor mechanical axis or beam center are available for use in the Measurement processing section 14. The seeker sensor 18 is mechanically or electronically pointed toward the nominal location of the target (represented by block 22), and extracts a signal indicative of the angular difference between the target and the 'sensor beam'. The range to the target 22, or some information related to target range, is also provided by the seeker sensor 18. In some cases, the range rate may also be measured explicitly as well.

The design and performance of the system 10 is a function of the target anticipated, or sensed. In the absence of specific information on the target 22 under attack, the design must be based on a composite target (or multiple target) specification. For the purposes of this discussion, the target 22 is assumed to be 'airplane-like', winged, pulling g's on its 'bottom', and banking to turn. The amount of target maneuver expected and the dynamic responsiveness of the target to commanded maneuvers are factors in the system design. While the discussion herein is centered on the assumption that the target axis and its velocity vector are collinear, these concepts can be extended to include a target that (realistically) must have an angle of attack to support a maneuver.

Figure 2:
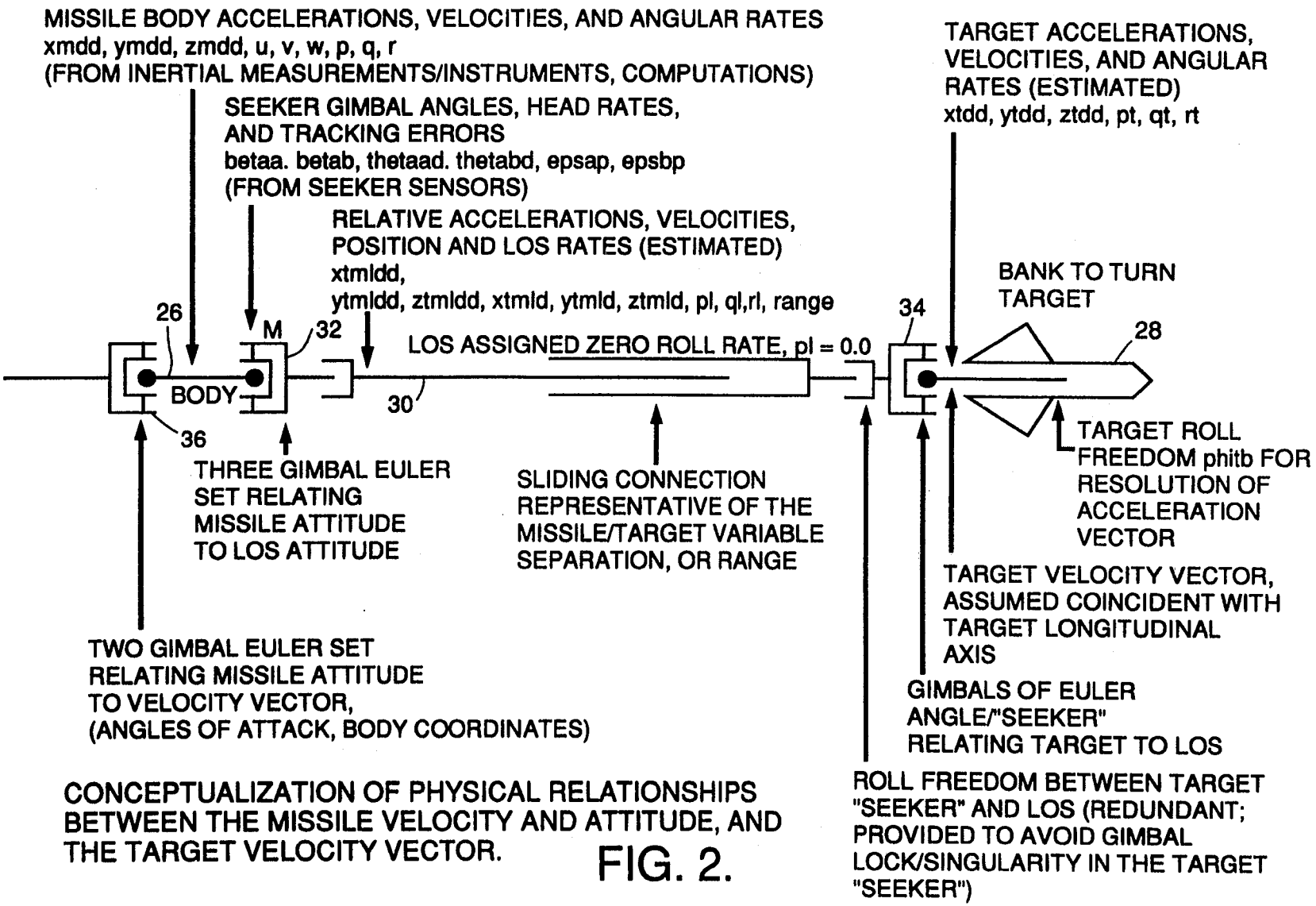
FIG. 2 is a diagrammatic illustration which shows the mechanical conceptualization according to the present invention which relates the vehicle to the target.

The main thrust of the invention is in the Measurement processing section, the Target State Estimator, and the Guidance Command Generator, which is based on a definite conceptualization 24 of the relationships among the missile, the wind, the seeker/sensor, and the target body. As shown in FIG. 2, the two foundational elements of the conceptualization are the missile body 26 and the target body 28. The missile and the target are connected by the line-of-sight ("LOS") 30. Neither the missile nor the target can evade the line-of-sight. They are always on it, and their actions 'drag' it around in the sky. That is, the missile velocity vector pulls the missile end of the LOS around and the target velocity vector pulls the target end of the LOS around. The missile is, conceptually, angularly located with respect to the LOS by the three 'gimbal' Euler angle set 32 at its end of the LOS 30. The target axis (coincident with the target velocity vector) is, conceptually, angularly located with respect to the LOS by a three 'gimbal' Euler angle set 34 at its end of the LOS. The LOS 30 can stretch or shrink in length, and the length of the LOS is the range. In this regard, the LOS 30 may be visualized as a curtain rod.

At the missile end of the LOS 30, there is an additional 'two gimbal' angular set 36 to define the missile velocity vector location with respect to the missile body 26. These two angles are usually less than 30 degrees, or so, and are known as the 'missile angles of attack'. For seekers with look angles of less than 90 degrees, there is no gimbal lock or singularity problem with the three Euler angles. At the target end of the LOS 30, there is an additional angular degree of freedom provided to 'track' the 'roll' angular attitude of the target with respect to the target velocity vector. Since the target aspect with respect to the LOS can be anything, there is the finite possibility of a singularity, or a 'gimbal lock', in the Euler angle representation. Therefore, the dual roll freedoms of the 'universal joint' connecting the target body 28 and the LOS 30 are used to maintain the gimbal set 34 in an attitude far from gimbal lock. Using the assumption that the target lifts on its 'bottom', the target roll orientation can be estimated when it is lifting, or accelerating laterally, since acceleration normal to the target axis must correlate with the target 'bank' angle.

Figure 3:
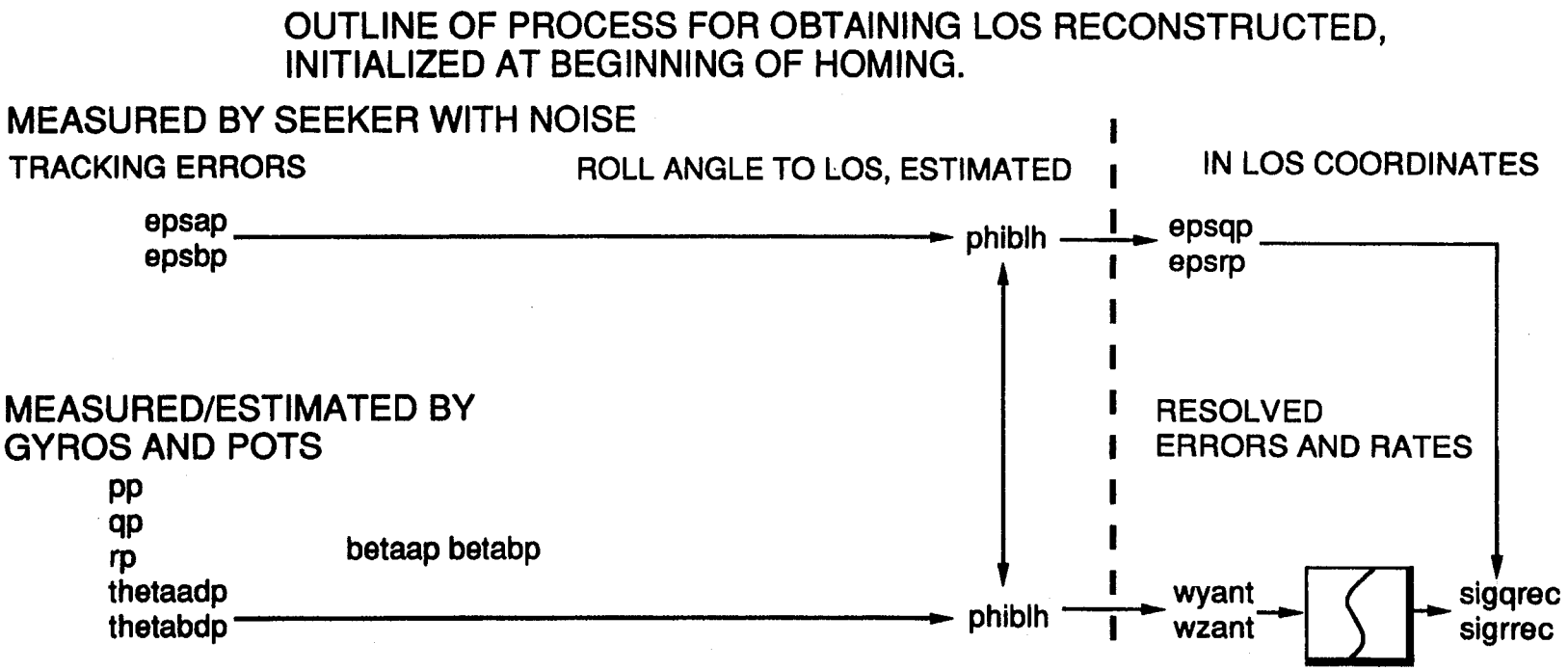
FIG. 3 is a diagrammatic illustration which outlines the standard process for computing the reconstructed line-of-sight angle.

The foundational information for homing is the orientation and length of the LOS vector. In this regard, FIG. 3 illustrates a chart which relates the (generally standard) approach to computing the measured orientation of the LOS 30. For convenience, the orientation is obtained in a context wherein the LOS vector does not roll (i.e., an inertial roll rate sensor attached to the LOS 30 would sense no roll rate). Note, in the conceptualization illustrated in FIG. 2, both the missile and the target are free to roll without 'dragging' the LOS along in roll.

The process for determining the reconstructed LOS angles, sigqrec and sigrrec, simply initializes the angles to zero at a convenient time, transforms the sensor axis rate into the non-rolling frame, integrates the rates to angle, and adds the measured tracking error (which has, likewise, been transformed into the non-rolling frame). More specifically, the seeker sensor 18 provides (noisy) measurements of the tracking error, the two potentiometer angles, and the two non-orthogonal head rates. In contrast, the missile rates are measured by gyros. Converting the measured rates and angles into the correct coordinate systems, the angle between the antenna of the missile and the LOS, in a non-rolling LOS coordinate system, can be estimated. Integrating the head rates in the non-rolling coordinate system and adding the tracking errors in the same coordinate system recreates the LOS angles, as they have changed since the initiation of the reconstruction.

If it is reasonable that the changes in these LOS angles are small during the period of homing guidance, then they can be treated as essentially orthogonal angles, without a practical error. However, if the changes in these angles are sufficiently large, then they can and should be treated with more complexity. Thus, if necessary to accommodate very large changes in direction after the start of homing, the reconstructed LOS angles can be treated as Euler angles, rather than simply small orthogonal angles. The ensuing description assumes that they are 'small enough' and orthogonal angles. In fact, the homing process cares little about the magnitude of these angles, being more concerned with hulling their rates of change.

Figure 4:
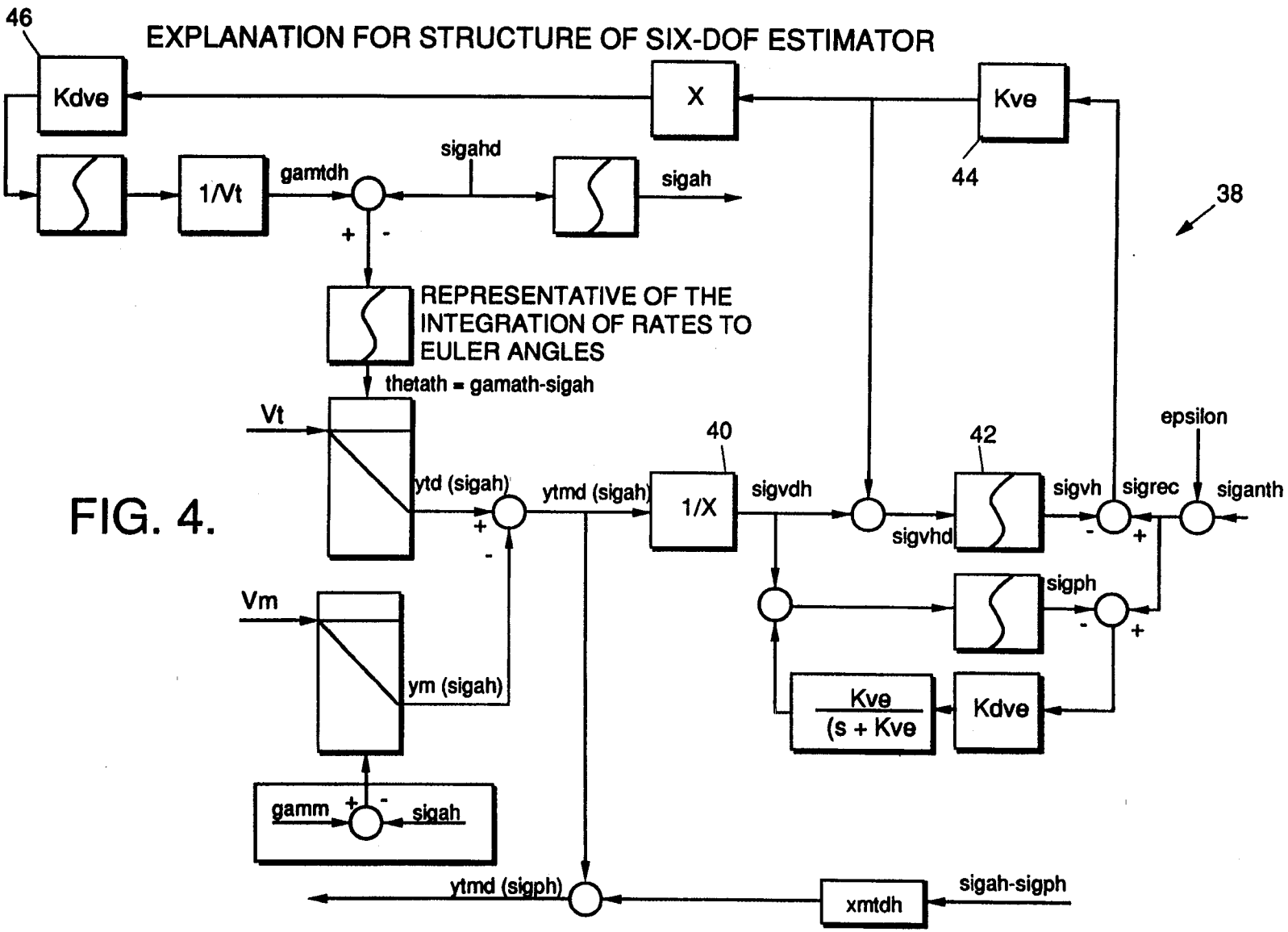
FIG. 4 is a block diagram which provides an overview of a single plane of the target state estimator.

Turning now to FIG. 4, a simplified illustration of the Target State Estimator 38 is shown. Note that the inputs at the right are the measured angle of the sensor axis and the tracking error (i.e., the angle by which the sensor indicates that the target is off of the sensor axis). The resulting variable created is shown to be sigrec (short for the angle sigma reconstructed). The heart of the Target State Estimator 38 is the 'model of truth', moving right from the target velocity magnitude, Vt, and the missile velocity magnitude, Vm. Vt acts at an angle thetath (theta target hat (estimated)) with respect to the LOS 30, and Vm acts at an angle thetam (theta missile) (assumed known from measurements) with respect to the LOS. 'Vt*sin (thetat)=ytd' defines the target velocity normal to the LOS, and 'Vm*sin (thetam)=ymd' defines the missile velocity normal to the LOS. Their difference, ytmd, defines the relative velocity normal to the LOS 30. Division of ytmd by range (x) at block 40 converts relative velocity to angular rate, sigvd, and then integration at block 42 generates the angle sigvh. The remaining upper structure of the Target State Estimator 38 is, basically in Kalman filter format, trying to match the angle estimated from the model of truth to the reconstructed angle from measurements.

Normally, the relationship between each of the gains Kve 44 and Kdve 46 is a fixed ratio. Thus, the familiar relationships hold. If Kve is large, the estimate will quickly come to match the measurement (including noise), and if Kve is small, the estimate will slowly tend to match the measurement (filtering out some of the noise). In a radar based seeker/sensor, there will be another effect. If Kve is large, the parasitic radome feedback loop will tend to be unstable. However, in accordance with the present invention, a computation is included to limit the magnitude of Kve to that which will preserve stability margins in the radome parasitic loop.

It should also be noted that there are indicated three estimates of the LOS angle: sigah, sigvh, and sigph. Sigvh is, evidently, the 'mainstream' estimate. Sigah is a high bandwidth estimate which does not significantly differ from Sigrec. Sigph is a lower bandwidth estimate that does not significantly differ from sigrec. Note that there are common gains in the estimation of sigvh and sigph. Sigah is provided so that the angles thetath and thetamh will reflect the highest bandwidth LOS information available. Sigph is provided so that the noise will be attenuated somewhat and so that the spectral characteristics of the estimated LOS angle will match the spectral characteristics of the estimated target velocity angle, gamth. This allows the output, ytmd (sigph), to have less noise and to be a timely comparison of the angle of the relative velocity vector and the angle of the LOS 30.

Figure 5:
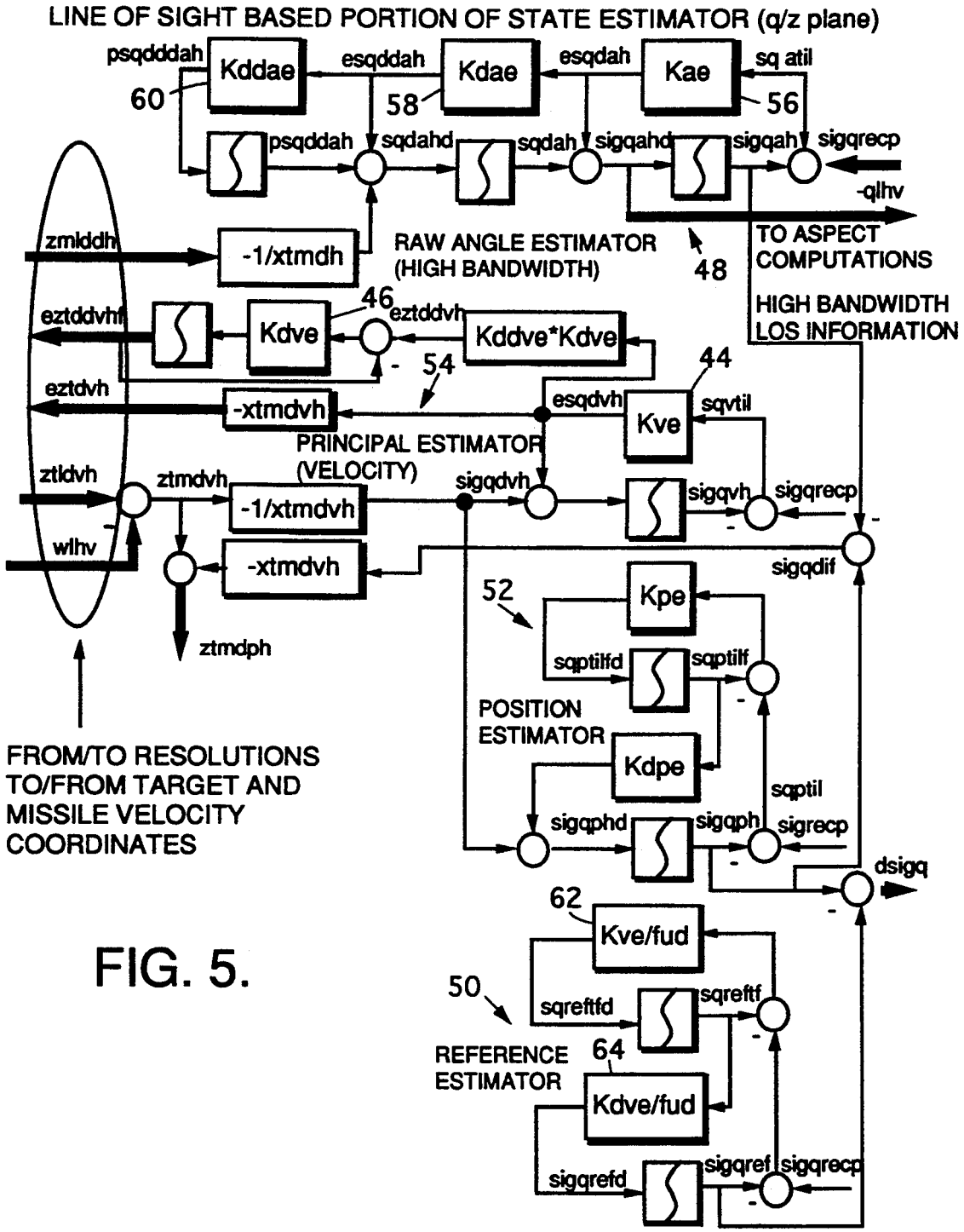
FIG. 5 is a block diagram which details, in a single plane, the portion of the target state estimator that operates in line-of-sight coordinates (as contrasted with target, missile, or rectangular inertial coordinates).

FIG. 5 is an expansion of the previous figure, which omits the resolution of missile and target velocities from body coordinates into LOS coordinates. The previous three angle estimates are represented (nomenclature is upgraded as the discussion moves into six degrees of freedom). The high bandwidth angle, sigqah, is the result of integrating sigqahd (sigma q(about the y axis) auxiliary hat(estimated) dot (the first derivative)). The principal, or velocity, estimate, sigqvh, is needed to close the loop on the estimation of ztmdvh. The position estimate, sigqph, is needed as a spectral match to ztldvh. An additional sigma variable, sigqref, is generated as a more stable LOS angle, substantially noise free, and representative of the average LOS angle over recent time. It is useful for generating acceleration commands to counter target acceleration.

The input and output signals at the left of FIG. 5 go to and from the conversion/transformation of information in LOS coordinates to target and/or missile coordinates, using angles based on the high bandwidth sigma and sigqah. The gamma and sigah estimates are derived from measured rates (and accelerations), and are tied loosely to the measured gimbal angles. Note that ym (sigvh) is not filtered (at high frequency) on its way to ymd (sigph) and the guidance law. The Euler angles relating the target velocity vector to the LOS (e.g., thetath) are obtained by the integration of rates. The most convenient estimate of the LOS rate is the rate-of-change-of-the-acceleration-based estimate of sigma. To obtain the missile velocity and the target velocity relative to the same LOS angle, the missile velocity normal to the LOS 30 needs, also, to be referenced to the acceleration-based estimate of sigma. However, for guidance, the velocity estimate should be normal to the position-state-based estimate of the LOS angle. The additional filtering which is present to obtain sigph is also present to equalize the frequency response of sigma and gamma, as referred to the target. Since the LOS rate is proportional to the difference between gamma and sigma, it is useful to have the frequency spectrums of the estimates of gammat and sigmat be equal.

Figure 6:
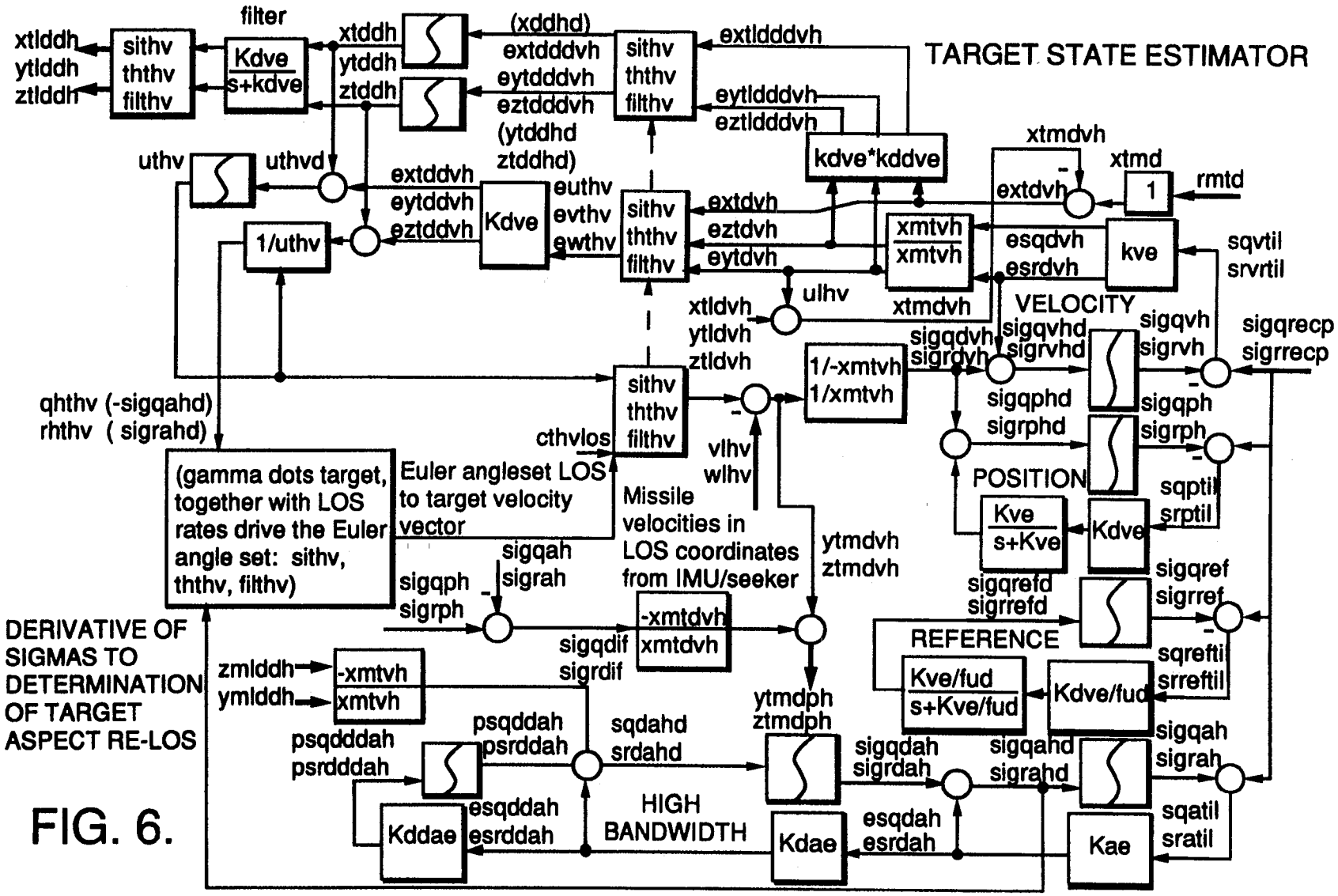
FIG. 6 is a block diagram which provides a further detail view of the target state estimator according to the present invention.

FIG. 6 completes the escalation of the Target State Estimator 38 to more completeness and six degrees of freedom. In this regard, the Target State Estimator 38 is shown to include a high bandwidth estimator 48 for most timely LOS angles sigqah and sigrah, a reference estimator 50 for most stable and noise free historical LOS angles sigqref and sigrref, a position estimator 52 for spectrally matched LOS angles sigqph and sigrph, and a mainstream, necessary velocity estimator 54 for sigqvh and sigrvh. The high bandwidth estimator 48 is explicitly driven by missile acceleration normal to the estimated LOS 30. The velocity estimator 54 is explicitly driven by the missile velocity normal to the most timely estimate of the LOS 30. The position estimator 52 is implicitly driven by the missile velocity normal to the most timely estimate of the LOS 30. The reference estimator 50 is independent of the missile acceleration or velocity, except as present in the reconstructed LOS.

The explicit, direct, unfiltered, feedback of the missile motion (without a wait to observe said motion in a change of the LOS angle) is another unique aspect of this invention. This form of feedback is also an element of substantial value in reducing the miss distance and improving system stability (i.e., reducing settling time). It is considered important to note that the missile accelerations and velocities used in the Target State Estimator 38 should be freed from transient indications of control activity. These indications normally contaminate the accelerations measured on the missile, and they must be removed before the information is integrated and/or used in the state estimator and guidance law.

Figure 10:
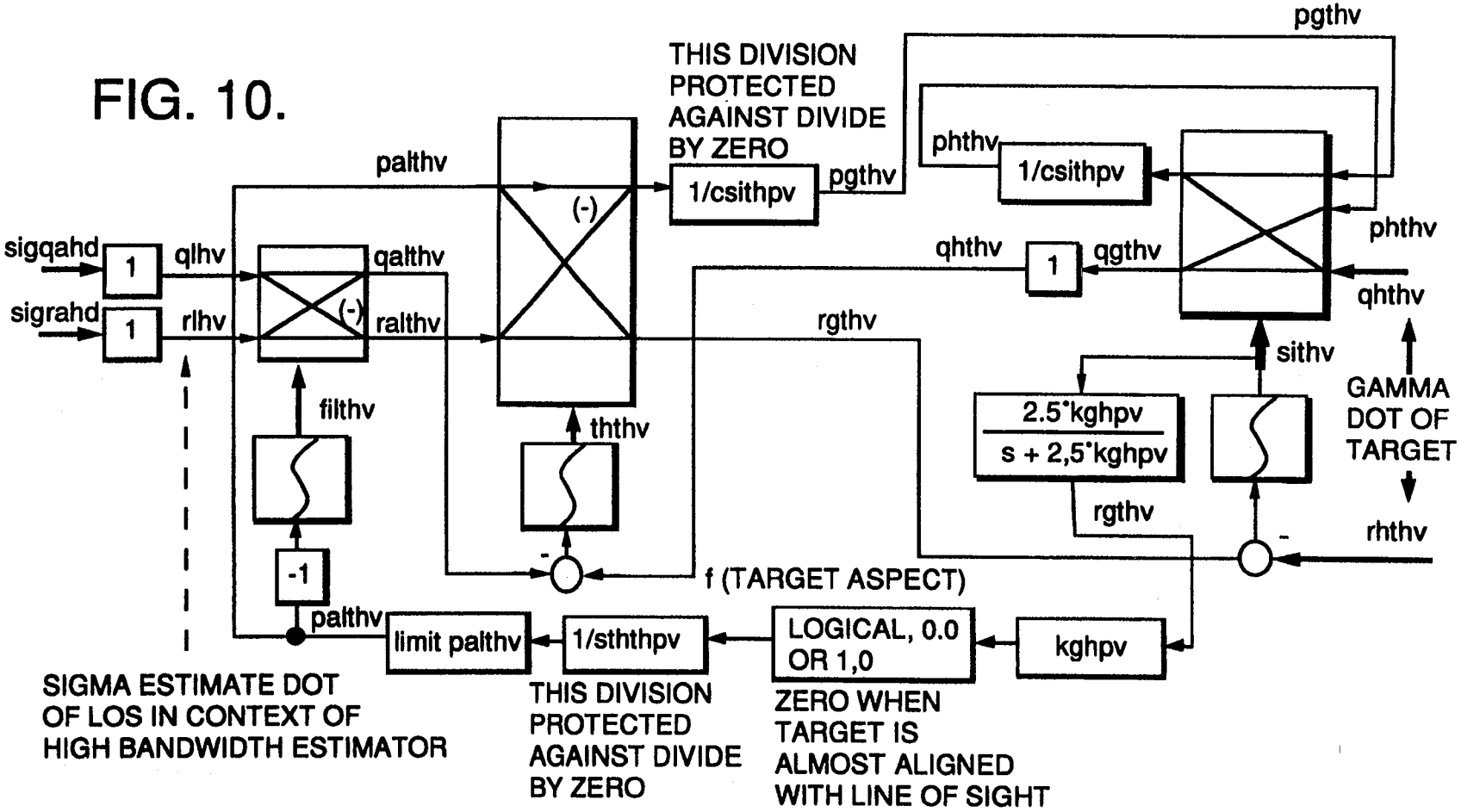
FIG. 10 is a block diagram of the portion of the measurement processing section which details how the estimated line-of-sight rate and the target velocity-vector-turning-rates are processed to estimate the Euler angles between the line-of-sight and the target velocity vector.

The detail of the generation of the Euler angles sithv, ththv, and filthv is given in FIG. 10. Note that the right hand portion of FIG. 6 is little more than an expansion of the previous diagram. Much of the left hand and upper portion is in target velocity vector coordinates. In this area, the acceleration of the target velocity is estimated. The axial acceleration of the target velocity vector is used to change the magnitude of the target velocity. The lateral components of the target acceleration are used to change the angular rates of the target velocity vector. This use of the target acceleration estimates, that is, the conversion to gammadots of the target velocity vector, is believed to be another unique aspect of this invention, wherein continuity is given to the target state in its own coordinate system in magnitude, direction, rate of change of magnitude, and velocity-vector-turning-rate. Filtered versions of the target acceleration are obtained for use in the generation of guidance commands. The relative velocity of the target with respect to the missile, normal to the position-based estimate of the LOS 30, is made available for use in the generation of guidance commands.

It should be appreciated from the above that a complete description of the target velocity vector's orientation with respect to the LOS 30, with respect to the missile centerline, and with respect to the relative velocity vector is explicitly available at intercept. Simultaneously, the information for predicting the magnitude of the ensuing miss is also available. Given sufficient precision in the range measurement, the entire set of information needed to set the timing of the warhead burst is available (except, possibly, for other measured or available information, such as the size and shape of the target, and/or the location of the more vulnerable parts of the target).

The gains Kve 44 and Kdve 46 are established by radome loop stability constraints. The means for their computation are provided in the simulation code, which is set forth at the completion of the description herein. The use of a mechanization that maintains stability and is continually responsive to system and flight conditions is a further unique aspect of this invention. There may arise high noise conditions wherein the missile will use too much energy with the high bandwidth allowed by the stability criterion. In this event, it will be prudent to measure the signal that is driving the excessive energy consumption, and reduce these gains, on line, accordingly. Similarly, there may arise an excessive noise level at saturation nonlinearities, reducing the flow of bonafide information. Again, this symptom can be measured on line, and the gains reduced accordingly. Some of the system points affected are in the 'autopilot', so there may need to be feedback from the autopilot.

The gains kae 56, kdae 58, and kddae 60 are system-dependent, and will be set as high as reasonable, given the sample rate and noise structure of the engagement. Nominally, Kae 56 is the highest, and equal to the sample rate in samples per second. Kdae=0.4*Kae, and Kddae=0.4*kdae. The gain fud (shown in blocks 62–64) is available as a system level trade between mission objectives. If fud is small, the reference direction will approach the instantaneous LOS direction, and the system performance will favor recovery from heading errors at acquisition. If fud is large, the reference direction will tend toward a constant. A chosen large value of fud will tend to favor response to late high-g target maneuvers. Hence the selection of fud is heavily influenced by the expected mix of end game challenges that the system will face.

Figure 7:
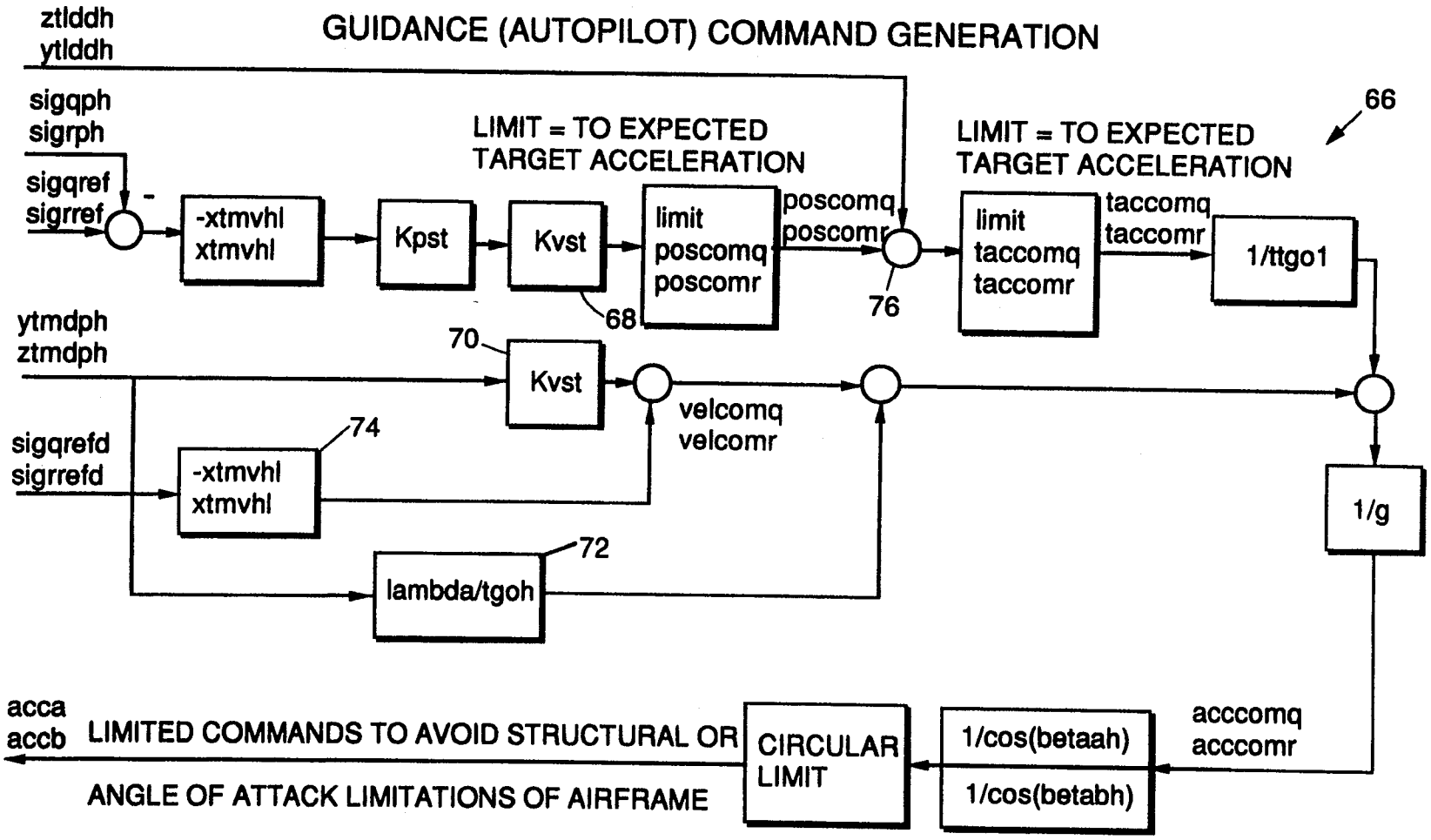
FIG. 7 is a block diagram of the command section which generates the steering acceleration commands to the vehicle's autopilot from the information received from the target state estimator.

Referring to FIG. 7, the utility and utilization of the information generated in the Target State Estimator 38 are illustrated by the Guidance (autopilot) Command Generator 66. The principle input is the relative velocity pair ytmdph and ztmdph. The output is the acceleration command pair acca and accb.

The missile, with its fin angular acceleration limit, its fin rate limit, its fin deflection limit, its structural lateral acceleration limit, and its aerodynamic control angle of attack limit, has a limited ability to respond to guidance commands. If it is overdriven (i.e., the guidance gain is too high), the system 10 will be unstable and susceptible to unintended oscillations in the end game when excited by noise or sudden target maneuvers. The gain Kvst (shown in blocks 68–70) is therefore limited in magnitude, if stability is to prevail through the end game. Therefore, the maximum value of Kvst, for stability, is dependent on the acceleration loop gain of the autopilot, Ka. At long times to go (>>1.0 sec), the maximum gain for stability is too high. This is well known. Many good studies have shown that the optimum linear system gain (with instant autopilot response, for low miss and low energy usage), is 3/tg (three divided by the time to go). Realism and experience give a range of 3/tg to 6/tg. Thus, the compromise represented here is 3 to 6 divided by time to go at long time to go limited; at short time to go, Kvst=0.4*Ka. (Note, the 0.4 factor could range from 0.4 to 0.5, as a function of the uncertainty in autopilot parameters.)

Kvst enters into the radome loop stability equations. Should a high value of Kvst require a value of Kve less than Kvst, it is counter-productive. Hence, Kvst is not allowed to be higher than Kve. A Proportional Navigation path through lambda/tgoh (block 72) is also incorporated in the diagram, but the recommendation is lambda=1.0. Lambda is nominally one, but resembles the classical proportional navigation factor in its impact. Ttgo 1 is a function of time to tgoh, and nominally, Ttgo=tgoh+1.0. A minor term accommodating the rate of turn of the reference direction is shown emanating from sigqrefd and sigrrefd (at block 74).

Matching the estimated target acceleration, because it is subject to change, is not an important input at long time to go, but can be crucial at short time to go. If the missile is unable to match the target acceleration normal to the LOS, explicitly, then the acceleration command to prevent an increasing miss must come from the relative velocity normal to the LOS, through Kvst. Since the miss is proportional to this relative velocity, a miss is virtually inevitable. Hence, the estimates of target acceleration, ytlddh and ztlddh, after limiting and at short time to go, are directly added to the missile command (at point 76).

When the target starts to accelerate, normal to the LOS, there will be a tendency to move the actual LOS 30 with respect to the more stable reference direction. This is a clue that the target is accelerating, and serves as a source of information to command missile acceleration. Hence, this difference is converted to position by multiplying by range and gain by Kpst and Kvst. The resulting command is limited to the order of magnitude of the expected target acceleration. The gain Kpst has an influence on stability similar to Kvst, and is kept below about 0.4*Kvst.

When the intercept problem is recovery from a heading error at acquisition, command through Kpst is damaging, tending to increase miss. But, when the intercept problem is recovery from a well-timed target maneuver, the command through Kpst is helpful. If it were known which problem was being solved, the gain Kpst could be tailored to the situation. Therefore, a nonlinear treatment of Kpst is detailed, in the simulation listing below, which allows full Kpst at high target acceleration, and near-zero Kpst at low target acceleration. The commands generated by this process result in responsive missile maneuvers (within the real capabilities of the missile) and stability. Higher gains may produce less miss in some difficult circumstances, but will result in transient-induced miss in the more frequent, less difficult engagements.

Figure 8:
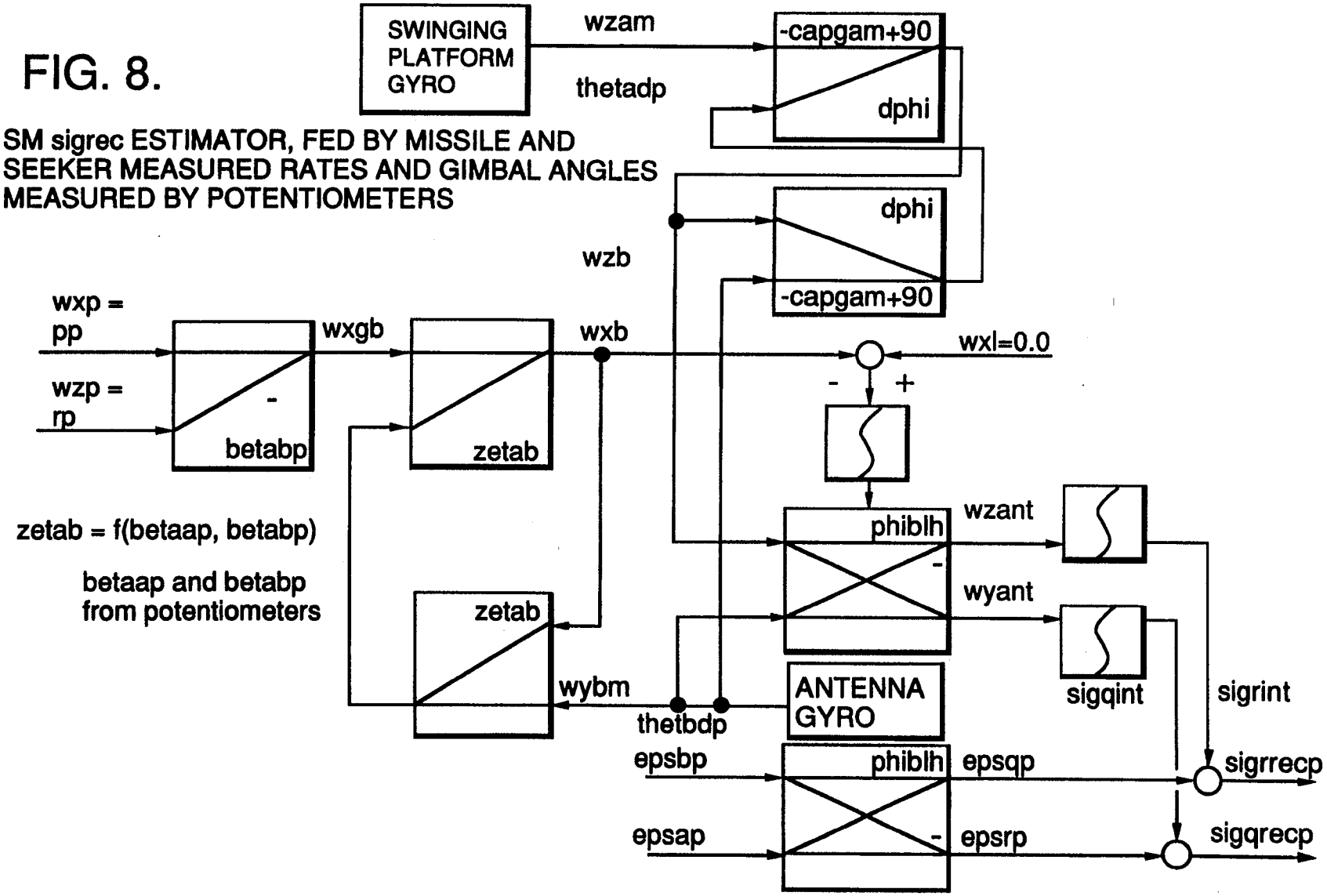
FIG. 8 is a block diagram of the portion of the measurement processing section which combines the information from a particular seeker mechanism to obtain the reconstructed line-of-sight angle to the target.

Referring now to FIG. 8, a portion of the Measurement processing section is shown. This portion of the Measurement processing section details the mechanization that combines the reconstructed LOS angle to the target. The representation in this figure is custom to the Standard Missile seeker configuration, which consists of several more parts and degrees of freedom than does the conventional two (Euler angle) gimbal seeker. In any event, the missile angular rates (as measured by missile rate sensors), the gimbal angles (as measured by potentiometers), and the rates measured by rate sensors on the seeker head provide the information necessary to reconstruct the LOS angle as perceived by the seeker.

Figure 9:
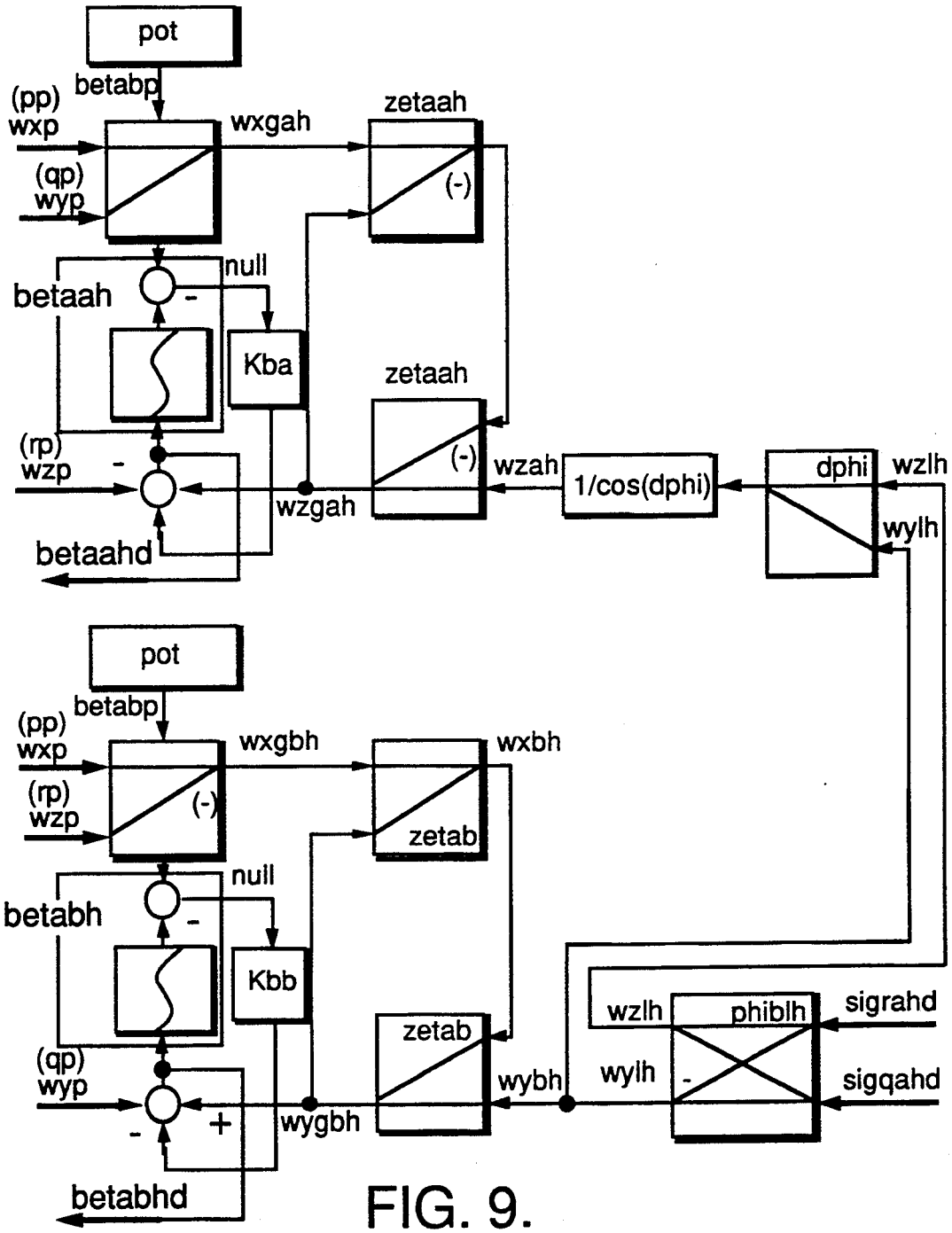
FIG. 9 is a block diagram of the portion of the measurement processing section which details how the estimated line-of-sight rate is processed to obtain estimates of the angles and angle rates between the vehicle and the line-of-sight.

FIG. 9 also details how the estimated LOS rate is processed to obtain estimates of the angles and angle rates between the missile and the LOS 30. This figure is also custom to the Standard Missile seeker gimbal arrangement. Nevertheless, the basic message is that, given the estimated LOS rate and the measured missile body rate, and available reference to the measured gimbal angles, the LOS angle rate with respect to the body and the angle of the LOS with respect to the body can be estimated. The angles zetaah, zetabh, and dphi are computed, by use of the physical structural constraints of this seeker mechanism, from betaah and betabh. In a simple two-axis gimbal system, these angles would not be present in the mechanism. That is, this area of the representation is tailored to the seeker mechanization detail. To suppress long-term drift, the estimated angle can be driven slowly back toward the measured angle. These estimated angles are required in order to resolve missile velocity and acceleration into estimated LOS coordinates (rather than into sensor axis coordinates). The procedure whereby missile variables are appropriately resolved into estimated, rather than sensor coordinates, is another important feature of the invention.

FIG. 10 was referred to earlier, and is a key part of the Target State Estimator 38 of the invention. First, the Euler angle set is driven by the rate-of-turn of the target velocity vector (recall that it is assumed that the missile body centerline and the velocity vector are collinear, that is, that the target can lift at small angle of attack). Second, the Euler angle set is driven by the estimated LOS rate. The result is the set of three angles relating the target velocity vector to the LOS. These angles are then available to transform errors from LOS to target coordinates, and estimates from target coordinates to LOS coordinates.

A portion of the design is devoted to the 'busy work' of keeping the gimbal set out of gimbal lock, or the Euler transformation away from a singularity (depending on one's point of view). The inputs are shown as the estimated angular rates of the target velocity vector, qhthv and rhthv, and the estimated angular rates of the LOS, sigqahd and sigrahd. The outputs are highlighted as the three Euler (gimbal) angles filthv, ththv, and sithv. The gain kghpv (block 78) is not a critical parameter, needing to be only large enough to roll the gimbal system out of the domain of gimbal lock. The error would have to reach a full 90 degrees before catastrophe would threaten. A chosen value is indicated in the computer simulation listing below.

In light of the above, it should be appreciated that there is a number of features in the present invention which alone and in combination produce substantially improved performance after acquisition at short time to go, after sudden target action at short time to go, and in the presence of noise. The emphasis on stability, with or without a radome problem, is cognizant of the systemic nature of the problem, and the risk in neglecting the important influence of the 'autopilot' on the system responsiveness and stability. It should also be appreciated that the autopilot/missile acceleration measurements should be decontaminated of high frequency inputs due to control forces. Additionally, missile acceleration and velocity should be resolved into estimated line-of-sight coordinates, not into reconstructed (measured) line-of-sight coordinates.

Emphasizing the target velocity and acceleration state in target coordinates allows/enforces a logical behavior pattern in the target's own coordinate system, and assures coordinated continuity in the subordinate estimates. Allowing the target a roll degree of freedom allows the estimation of the target roll or bank angle, and aids the fusing algorithm in predicting/determining the portion of the target to be sensed, or sensed, by the Target Detection Device. Using an Euler angle conception of the relationship of the target and the LOS allows a relatively simple angle generation scheme. (There are other options which flow from the same basic conceptualization. For example, the relationship of the target and the LOS could be represented by Quaternions, with essentially the same result, but with substantially increased complexity). Conceptualizing the angular relationship of the missile and the LOS in gimbals is appropriate, as the seeker may have actual gimbals that are closely related to the conceptual gimbals.

The fundamental measured homing information is the LOS from the missile to the target (with range and range rate). The Target State Estimator's job is to have the modeled flying target and the real missile produce a LOS angle that matches the estimate, and then have Guidance fly the missile to the estimated target location, by putting the relative velocity vector on the estimated LOS. Given that the key limitation on estimator bandwidth is the stability of the radome loop, it is desired to make the estimator bandwidth as high as possible, with stability. If noise saturation of forward path nonlinearities, or excessive energy utilization by drag or control horsepower, is the key limitation, the estimator gains can and should be lowered accordingly.

From the above, it should be appreciated that the present invention provides a guidance system in which the high frequency contamination of missile acceleration measured, and velocity and position derived, by the instant response of accelerometers to missile control action is suppressed. In other words, the guidance system is one in which the trim acceleration due to angle of attack is the acceleration indication utilized in closing the guidance and control loops.

There is a specific purpose for each of the four estimates of LOS angle; sigqah, a maximum bandwidth signal; sigqvh, incidental to finding sigqdvh; sigqph, a match spectrum replacement for sigqah; sigqref, a slower changing past value. Sigqah allows the target velocity estimate to be generated with respect to the 'rawest' indication of the measured LOS angle. Sigqvh is a necessary intermediate and incidental estimate. Sigqph replaces sigqah to improve the spectral match between the angle of the relative velocity vector and the angle of the LOS. Sigqref is useful in conjunction with sigqph in providing another source of acceleration command to counter a maneuvering target. In order to enhance the responsiveness of the missile to changes in the estimated target state, all missile states are fed back without delay.

In order that the invention may be more thoroughly understood, a listing is presented below of a computer simulation which emulates the features of the advanced homing guidance system:

```
      subroutine tgiddocu

        implicit real (a-h,k,n-z)
      integer nstart,nfirst,nexit,ntargt,kss,kh,ksw2,krh
     .          ,khmax,krhm,np
C
      parameter (re=2092615.,xscale=1.0,xbias=0.)
      parameter (bbb=.45,cccacc=0.5,cccvol-0.5,cccpos=.5
     .          ,rdmdos=.03,sf=2.0,ggg=1,0,hhh=0.1,
     .          ytddlim=480.,kat - 2.
     .          ,fff=1.0,tgob=2.0,palthlm=0.0,taukvo=0.02
     .          ,kveldl=500.)
      paramater (pi=3.141592654, cdr=.017453293,
     .          crd=57.29577951,g=32.174, di=13.5, d=1.125,
     .          s=.994019551,ckf=1.687888889, cfk=.59245606,
     .          ctmf=6076.115,cftm=.0001645788,
     .          qcon=1481.3563)
      paramater (immax=4, jrmax=3, khmax=4, lkmax=2
     .          ,ivtm=6, jegm=7, krhm=5)
      dimension dc(3,3), dct(3,3), cmh(3,3), cmht(3,3)
     .          , chtoi(3,3), citolhv(3,3), clhvtoi(3,3)
     .          , clhvtob(3,3), cbtolhv(3,3), cthvlos(3,3)
     .          , closthv(3,3), citolos(3,3), citol0(3,3)
     .          , clhvtol0(3,3), cl0tolph(3,3)
     .          , clhvtolph(3,3)
      common time ,delt ,nstart ,nfirst ,nexit
     .     ,ipass ,ntargt ,xnoise(8), rmt ,delmtn
     .     ,delmte ,delmtd ,romcon(3164)
C     ADD COMMON BLOCK TO COMMUNICATE FROM AUTOP_ER TO
      TRMGUID_IC COMMON /INP6/ aycomp ,azcomp ,ALFA_g
      ,BETA_g ,aKA ,alfa_e ,beta_e
     .     ,xMAGyb , ACMD , BCMD
      common/wwaym aero/cy,cz,cm,cn,cmd,cnd,cyd,czd
      common /every/ snt ,set ,sdt ,sntd ,setd ,sdtd
     .          ,sn ,se ,sd ,snd ,sed ,sdd
     .          ,u ,v ,w ,ud ,vd ,wd
     .          ,p ,q ,r ,pd ,qd ,rd
     .          ,ax ,ay ,az ,torqux ,torquy ,torquz
     .          ,psi ,tha ,phi ,psid ,thad ,phid
     .          ,alpha ,beta ,alphad ,betad ,alphat ,phiw
     .          ,cosxn ,coxyn ,coszn ,cosxe ,cosye ,cosze
     .          ,cosxd ,cosyd ,coszd ,sxt ,syt ,szt
     .          ,ut ,vt ,wt ,xmach ,vm ,vtt
     .          ,ertiax ,ertiay ,ertiaz ,weight ,thrust
     .          ,cgst
     .          ,aca ,acb ,press ,rmtd ,ambda ,h
```

```
     .          ,vsound ,eiota(4)
c
      common /guide/ epsap ,epsbp ,thetadp ,thetbdp ,betaap
     .          ,betabp ,betaac ,betabc ,sigt
     .          ,tact ,tpitch ,tslew ,tmidc ,tacq ,tacq1
     .          ,timtr ,enltim ,tgo ,ttr
     .          ,t2 ,h2 ,e2 ,eg ,bg ,vnr
     .          ,re ,rh2 ,surf ,zlowe ,mode ,irate
     .          ,hm ,tss ,kss ,nclmq ,enl
     .          ,acapo ,acbpo ,acamc ,acbmc ,acatr ,acbtr
     .          ,gbias ,lowair ,islow ,ssingvs, iaegis ,ivl
     .          ,iqm ,blk3flg, cg52flg
c
      common /inst/ kn, kfa, kdfd, pp, qp, rp, apy, apz
c
      common /irout/ xm,ym,zm,xt,yt,zt,xmd,ymd,zmd,xtd,ytd
     .          ,ztd,hmiru
c
      COMMON /INP6FLG/ INP6_GUID , INP4_AP
c
      if (nstart) 20,30,10
 10   continue
c
c     initialization
c
 20   continue
c
c     note that trmguid is called at intervals
c     (.02 sec)
        return
c
 30   continue
c
c          gbias=.707*sqrt(1.-(sdd/vm)**2)*sign(1.0,coszd)
c     no gravity for run_ic
          gbias = 0.0
cccccccccccccccccccccccccccccccccccccccccccccccccccccccccc
c              inp6x guidance initialization              c
cccccccccccccccccccccccccccccccccccccccccccccccccccccccccc
c
          if ( inp6_guid.eq.1 ) then
          if (time.gt.timtr.and.init.eq.1) then
           init=0
           dc(1,1)=cosxn
           dc(1,2)=cosxe
           dc(1,3)=cosxd
           dc(2,1)=cosyn
           dc(2,2)=cosye
           dc(2,3)=cosyd
           dc(3,1)=coszn
           dc(3,2)=cosze
           dc(3,3)=coszd
           etime = .001
           kvel = 0.1
           kveh = 0.01
           kdve = 0.05
```

```
kve   = 0.1
xtmvh     = sqrt((snt-sn)**2+(set-se)**2+
            (sdt-sd)**2)
xtmvh     = xscale*xtmvh + xbias
sigr0     = atan2(set-se,snt-sn)
denomsig  = (snt-sn)*cos(sigr0)+(set-se)*
            sin(sigr0)
sigq0     = -atan2(sdt-sd,denomsig)
sigrh     = 0.0
sigqh     = 0.0
sigrph    = 0.0
sigqph    = 0.0
sigrvh    = 0.0
sigqvh    = 0.0
sigrah    = 0.0
sigqah    = 0.0
call makedcm(sigr0,sigq0,0.0,citolhv)
call makedcm(sigr0,sigq0,0.0,citol0)
call trans(citolhv,clhvtoi)
call m3x33x1(citolhv,sntd,setd,sdtd,ulu,vlu,wlu)
uthv = vtt
if (abs(wlu).lt.1.0.and.abs(vlu).lt.1.0) then
   filthv = 0.0
else
   filthv = atan2(vlu,wlu)
endif
ctheta - ulu/vtt
stheta = (sin(filthv)*vlu+cos(filthv)*wlu)/vtt
ththv = atan2(stheta,ctheta)
sithv = 0.0
call makedcm(sithv,ththv,filthv,cthvlos)
call m3x33x1(cthvlos,vtt,0.0,0.0,xtldvh,ytldvh
     ,ztldvh)
call trans(citolhv,clhvtoi)
betaah = betaap + epsap
betabh = betabp + epsbp
cbetaah = cos(betaah)
sbetaah = sin(betaah)
cbetabh = cos(betabh)
sbetabh = sin(betabh)
dum1    = cbetaah*tan(betabh)
dum2    = cbetabh*tan(betaah)
dum3    = sqrt( 1.0 - (sbetaah*sbetabh)**2 )
capgam = asin(dum3)
zetaah = atan(dum1)
zetabh = atan(dum2)
dphi    = -(capgam - pi/2.0)
phiblh = 0.0
call makedcm(betaah,zetaah,phiblh,cbtolhv)
u2 =u
v2 =v
w2 =w
call m3x33x1(cbtolhv,u2,v2,w2,ulhv,vlhv,wlhv)
xtmdvh = xtldvh-ulhv
sigqdah = -(ztldvh-wlhv)/xtmvh
sigrdah =  (ytldvh-vlhv)/xtmvh
```

```
          tgoh = - xtmvh/xtmdvh
          stlddh = 0.0
          psqddah= 2.0*sigqdah/tgoh
          psrddah= 2.0*sigrdah/tgoh
          sigqdvh = sigqdah
          sigqphd = sigqdah
          sigrdvh = sigrdah
          sigrphd = sigrdah
          timlast=time-.019
          etime = 0.0
          call m3x33x3(citol0,clhvtoi,clhvtol0)
          call makedcm(sigrph,sigqph,0.0,cl0tolph)
          call m3x33x3(cl0tolph,clhvtol0,clhvtolph)
          cphiblh = cos(phiblh)
          sphiblh = sin(phiblh)
          SIGQINT = -(EPSbP*CPHIBLH - EPSaP*SPHIBLH)
          SIGRINT = -(EPSaP*CPHIBLH + EPSbP*SPHIBLH)
         endif
cccccccccccccccccccccccccccccccccccccccccccccccccccc
c          end inp6x guidance initialization       c
cccccccccccccccccccccccccccccccccccccccccccccccccccc
cccccccccccccccccccccccccccccccccccccccccccccccccccccccc
c                    inp6x estimator                   c
cccccccccccccccccccccccccccccccccccccccccccccccccccccccc
         if (time.gt.timtr) then
         deltime=time-timlast
         timlast=time
         xtmvh=sqrt((snt-sn)**2+(set-se)**2+(sdt-sd_**2)
         xtmvh = xscale*xtmvh + xbias
         if (xtmvh.lt.100.0) then
         xtmvh=100.00
         end if
         xtm = sqrt((cnt-sn)**2+(set-se)**2+(sdt-sd)**2)
         xtmd = sqrt((sntd-snd)**2+(setd-sed)**2+
                (sdtd-sdd)**2)
c         tgoh = -xtmvh/xtmdvh
         tgoh = xtm/xtmd
         if (tgoh.lt.100.0/xtmd) then
         tgoh=100.0/xtmd
         end if
         tgobias= amax1(0.00000010,tgoh-tgob)
         ttgol=tgoh+1.0
c integrate first order difference equations ************
c for estimation and guidance ***************************
         kvel      = kvel          +    kveld*deltime
         kveh      = kveh          +    kveld*deltime
         phiblh    = phiblh        -      wxb*deltime
         sigqint   = sigqint       +    wyant*deltime
         sigrint   = sigrint       +    wzant*deltime
         sqptilf   = sqptilf       + sqptilfd*deltime
         srptilf   = srptilf       + srptilfd*deltime
         betaah    = betaah        +  betaahd*deltime
         betabh    = betabh        +  betabhd*deltime
         sigqph    = sigqph        +  sigqphd*deltime
         sigrph    = sigrph        +  sigrphd*deltime
         psqddah   = psqddah       + psqdddah*deltime
```

```
      psrddah    = psrddah      + psrdddah*deltime
      xtddf      = xtddf        +   xtddfd*deltime
      ytddf      = ytddf        +   ytddfd*deltime
      ztddf      = ztddf        +   ztddfd*deltime
      xtddh      = xtddh        +   xtddhd*deltime
      ytddh      = ytddh        +   ytddhd*deltime
      ztddh      = ztddh        +   ztddhd*deltime
      sigqdah    = sigqdah      +   sqdahd*deltime
      sigrdah    = sigrdah      +   srdahd*deltime
      sigqah     = sigqah       +  sigqahd*deltime
      sigrah     = sigrah       +  sigrahd*deltime
      sqreftf    = sqreftf      + sqreftfd*deltime
      srreftf    = srreftf      + srreftfd*deltime
      sigqref    = sigqref      + sigqrefd*deltime
      sigrref    = sigrref      + sigrrefd*deltime
      uthv       = uthv         +    uthvd*deltime
      filthv     = filthv       +  filthdv*deltime
      ththv      = ththv        +   ththdv*deltime
      sithv      = sithv        +   sithdv*deltime
      sithvf     = sithvf       +  sithvfd*deltime
      sigqvh     = sigqvh       +  sigqvhd*deltime
      sigrvh     = sigrvh       +  sigrvhd*deltime
c adjust velocity and acceleration to be at center of
  percusion
      vmtot = sqrt(u**2+v**2+w**2)
      u2 =      VMTOT*cos(alfa_g)*COS(BETA_g)
      v2 =      VMTOT*SIN(BETA_g)
      w2 =      VMTOT*SIN(ALFA_g)
      ax2 = ax
c compensated accelerations from autopilot are aycomp and
  azcomp
c calculate guidance gains ******************************
c autopilot gain explicitly from autopilot
      ka = aka + .01
      akr= aka/bbb
      kv = Ka*bbb
      kp = kv*bbb
      kvst = kv/(1.0+tgobias*kv/3.0)
c limit kvst to kdve
      kvst = amin1(kvst,kdve)
      kpst = kvst*bbb
      kposf = kv*tgoh/1.0
      kposf = amin1(kposf,50.0)
c calculate frequently used sines and cosines
      sfilthv = sin(filthv)
      cfilthv = cos(filthv)
      sththv = sin(ththv)
      cththv = cos(ththv)
      ssithv = sin(sithv)
      csithv = cos(sithv)
c define real LOS angles
      sigr = atan2(set-se,snt-sn)
      denomsig = (snt-sn)*cos(sigr)+(set-se)*sin(sigr)
      sigq = -atan2(sdt-sd,denomsig)
c define missile/target velocities normal to real LOS
      call makedcm(sigr,sigq,0.0,citolos)
```

```
      call m3x33x1(citolos,sntd,setd,sdtd,ult,vlt,wlt)
      call m3x33x3(citolos,snd,sed,sdd,ulm,vlm,wlm)
      ytmld = vlt-vlm
      ztmld = wlt-wlm
c define real LOS angle rates
      sigrd =  ytmld/xtm
      sigqd = -ztmld/xtm
c **************find estimator gains********************
c find estimator gains via stabilization of the parasitic
  radome feedback
c set estimator gains (r for raw)
      kve   = amin1(kvel,kveh)
      kve   = amax1(kve,0.0001)
      kve   = amin1(kve,20.0)
      kae   = 2.0*kve
      kae   = amin1(kae,20.0)
      kdaer = kae*cccacc
      kddaer= kdaer*cccacc
c computation of the rates of change of radome stability
  based gains
      kvelfct=ka*kvst*rdmdes*xtmvh/xmagyb
      gcomp = (1.0/(ka+kvelfct*kvel*cccvel))/taukve
      kveld = (ka*(kvst+kvel)+kvel*kvel*cccvel*
              (1.0-kvelfct))*gcomp
      kveld  = sign(amin1(abs(kveld),kveldl),kveld)
      kvehd  = ((akr/kvst-1.0)*xmagyb/rdmdes/xtmvh/
               cccvel-kveh*kveh)/kveh/taukve
      kvehd  = sign(amin1(abs(kvehd),kveldl),kvehd)
      kdver = kve*cccvel
      kddver= kdver*cccvel
      kpe   = amin1(kve,20.0)
      kdper = kpe*cccpos
      kqhpv = kae
      ktrim = kdver
      kddf  = kdver
c face gains in over a settling time
      etime = etime + deltime*2.0
      gainm1 = 1.0 - 2.7**(-kae*etime)
      gainm2 = 1.0 - 2.7**(-kdae*etime)
      gainm3 = 1.0 - 2.7**(-kve*etime)
      gainm4 = 1.0 - 2.7**(-kdve*etime)
      kdae = gainm1*kdaer
      kdve = gainm3*kdver
      kdpe = gainm3*kdper
      kddae= gainm2*kddaer
      kddve= gainm4*kddver
c ****************end calculate estimator gains**********
c computation uses potentiometers to reconstruct LOS
  angles*************************************************
c to permit resolution of measured rates to head
  coordinates, and to find
c simulation truth.
c  find direction cosine matrix of missile and its
   interverse (transpose)
      call makedcm(psi,tha,phi,dc)
      call trans(dc,dct)
```

```
c cómpute sigqrecp and sigrrecp from inputs of missile
  measured rates,
c seeker measured rates and seeker measured angles.
c
c betaap and betabp are measured gimbal angles
c epsap and epsbp are tracking errors, tolerances
  modelled.
c pp, qp, rp are measured missile body rates
c thetadp, thetbdp are head rates (limited with errors,
  w/o dynamics).
c
        wxp = pp
        wyp = qp
        wzp = rp
c using measured angles (betaap,betabp) to compute other
  angles that are
c constrained by the mechanism.
        cbetaap = cos(betaap)
        sbetaap = sin(betaap)
        cbetabp = cos(betabp)
        sbetabp = sin(betabp)
        dum1  = cbetaap*tan(betabp)
        dum2  = cbetabp*tan(betabp)
        dum3  = sqrt( 1.0 - (sbetaap*sbetabp)**2 )
        zetaa = atan(dum1)
        zetab = atan(dum2)
        capgam = asin(dum3)
        dphi  = -(capgam - pi/2.0)
c redefining measured head rates
        wzam =   thetadp
        wybm =   thetbdp
c computing wxgb and then wxb, phiblh = -integration(wxb)
        wxgb = wxp*cbetabp = wzp*sbetabp
        czetab = cos(zetab)
        szetab = sin(zetab)
        wxb   = (wxgb*czetab + wybm*czetab*szetab)/
       &        (1. - (szetab**2))
c computing wyb from two gyro measurements
        cdphi = cos(dphi)
        sdphi = sin(dphi)
        wzb   = (wzam*cdphi + wybm*cdphi*sdphi)/
       &         (1. - (sdphi**2)
        wyb = wybm
c resolving antenna rates (B part) to LOS coordinates
  through phiblh
        cphiblh = cos(phiblh)
        sphiblh = sin(phiblh)
        wyant = wyb*cphiblh + wzb*sphiblh
        wzant = wzb*cphiblh - wyb*sphiblh
c computing the reconstructed LOS angles
        epsqp = epsbp*cphiblh + epsap*sphiblh
        epsrp = epsap*cphiblh - epsbp*sphiblh
c sigqint and sigrint are integrals of wyant and wzant
        sigqrecp = sigqint + epsqp
        sigrrecp = sigrint + epsrp
c end computations from measured data ******************
c
```

```
c finding differences between reconstructed LOS and
  estimated LOS
c position estimator
        sqptil  = sigqrecp-sigqph
        srptil  = sigrrecp-sigrph
c velocity estimator
        sqvtil  = sigqrecp-sigqvh
        srvtil  = sigrrecp-sigrvh
c acceleration estimator
        sqatil  = sigqrecp-sigqah
        sratil  = sigrrecp-sigrah
c reference estimator
        sqreftil= sigqrecp-sigqref
        srreftil= sigrrecp-sigrref
c for removal of noise on sigxah
        sigqdif = sigqph  -sigqah
        sigrdif = sigrph  -sigrah
c SM Euler Angle Estimator (from missile to estimated
  LOS)
c
c computing Euler angles, from missile body to estimated
  line of sight,
c using measured and estimated rates, with loose
  anchorage to the measured
c gimbal angles to be used in bringing missile velocity
  and acceleration
c into estimated LOS coordinates.
c
c kba and kbb suggested to be between 1.0 and 5.0
        kba = 5.0
        kbb = 5.0
c computing estimated second gimbal angles
        cbetaah = cos(betaah)
        sbetaah = cos(betaah)
        cbetabh = cos(betabh)
        sbetabh = sin(betabh)
        dum1    = cbetaah*tan(betabh)
        dum2    = cbetabh*tan(betaah)
        zetaah = atan(dum1)
        zetabh = atan(dum2)
c begin acceleration (angular acceleration) estimator
        esqdah  = kae*sqatil
        esrdah  = kae*sratil
        sigqahd  = sigqdah + esqdah
        sigrahd  = sigrdah + esrdah
c resolve los rates to rolling coordinates
        wzlh = sigrahd*cphiblh + sigqahd*sphiblh
        wylh = sigqahd*cphiblh - sigrahd*sphiplh
        wzah = (wzlh*cdphi+wylh*sdphi)/cdphi
        wybh = wylh
c compute inertial gimbal angle rate about controlled
  a-axis
        czetaah = cos(zetaah)
        szetaah = sin(zetaah)
        czetabh = cos(zetabh)
        szetabh = sin(zetabh)
```

```
      wxgah  = wxp*cbetaah + wyp*sbetaah
      wzgah  = (wzah*czetaah-wxgah*czetaah*SZETAAH)/
     &         (1. - (zetaah**2))
      betaahd = wzgah-wzp+kba*(betaap-betaah)
c compute inertial gimbal angle rate about controlled
  b-axis
      wxgbh  = wxp*cbetabh - wzp*sbetabh
      wygbh  = (wybh*czetabh+wxgbh*czetabh*SZETABH)/
     &         (1. - (szetabh**2))
      betabhd = (wygbh-wyp+kbb*(betabp-betabh)
c Resolving velocity and acceleration from body to sigrec
  coordinates
      call makedcm(betaah,zetaah,phiblh,cbtolhv)
      call trans(cbtolhv,clhvtob)
c rotate velocities and accelerations from missile body
  to estimated LOS
c u2,v2,w2 are used (adjusted to center of percusion)
c aycomp,azcomp are used (adjusted to center of
  percusion)
      call m3x33x1(cbtolhv,u2,v2,w2,ulhv,vlhv,wlhv)
c temporarily kill gravity input-----------------------
c       call m3x33x1(dc,0.,0.,1.,axg,ayg,azg)
      call m3x33x1(dc,0.,0.,0.,axg,ayg,azg)
      call m3x33x1(cbtolhv,g*(ax2+axg),g*(aycomp+ayg),
     .         g*(azcomp+azg),xmlddh,ymlddh,zmlddh)
c******* enter estimators ******************************
c
c reference sigma for comparison to position estimated
  sigma
      fud = 2.0
      sqreftfd = kve*(sqreftil-sqreftf)/fud
      srreftfd = kve*(srreftil-srreftf)/fud
      sigqrefd = kdve*sqreftf/fud
      sigrrefd = kdve*srreftf/fud
c position (angle) estimator
      sqptilfd = kpe*(sqptil-sqptilf)
      srptilfd = kpe*(srptil-srptilf)
c rates of change of position state based sigma-esimates
      sigqphd = kdpe * sqptilf + sigqdvh
      sigrphd = kdpe * srptilf + sigrdvh
c acceleration (angular acceleration) estimator
      esqddah = kdae*esqdah
      esrddah = kdae*esrdah
      psrdddah =  kddae*esrddah
      psqdddah =  kddae*esqddah
      sqdahd = psqddah-zmlddh/xtmvh + esqddah
      srdahd = psrddah+ymlddh/xtmvh + esrddah
c velocity (LOS rate) estimator
      esqdvh = kve*sqvtil
      esrdvh = kve*srvtil
      xtmd    = rmtd
      extdvh =  xtmd-xtmdvh
      eytdvh =  esrdvh*xtmvh
      eztdvh = -esqdvh*xtmvh
      extlddvh = extdvh*kdve*kddve
      eytlddvh = eytdvh*kdve*kddve
```

```
      eztlddvh = eztdvh*kdve*kddve
c make direction cosine matrix, target to LOS and LOS to
  target
      call makedcm(sithv,ththv,filthv,cthvlos)
      call trans(cthvlos,closthv)
c transform velocity and acceleration errors from LOS to
  target
      call m3x33x1(closthv,extdvh,eytdvh,eztdvh,
     .          euthv,evthv,ewthv)
      call m3x33x1(closthv,extlddvh,eytlddvh,
     .          eztlddvh,extdddvh,eytdddvh,eztdddvh)
c generate acceleration errors in target coordinates
      extddvh = kdve*euthv
      eytddvh = kdve*evthv
      eztddvh = kdve*ewthv
c pass target acceleration errors through a noise/radome
  filter
      xtddfd = kdve*(xtddh-xtddf)
      ytddfd = kdve*(ytddh-ytddf)
      ztddfd = kdve*(ztddh-ztddf)
      xtddhd  = extdddvh
      ytddhd  = eytdddvh
      ztddhd  = eztdddvh
c derivative of target speed
      uthvd = xtddh+extddvh
c target velocity vector turning rates
      qhthv =  (ztddh+eztddvh)/uthv
      rhthv =  (ytddh+eytddvh)/uthv
c rate of change of sigqah and sigrah
      qlhv = -sigqahd
      rlhv =  sigrahd
c *computation to prevent gimbal lock in target angles
  sith and thth*
c
c place lower limit on sin(ththv) to prevent division by
  zero
      sththpv = sign(amax1(abs(sththv),.01),sththv)
c dead zone
      sqrtstv = sqrt(ssithv**2+sththv**2)
      if (sqrtstv.lt.0.01) then
         dzv = 0.0
      else
         dzv = 1.0
      endif
c CONTROLLER TO NULL SITHV BY DRIVING PALTHV
c use filtered version of sithv
      sithvfd = 2.5*kghpv*(sithv-sithvf)
      palthv = sithvf*kqhpv*dzv/sththpv
      palthv = sign(amin1(abs(palthv),palthim),palthv)
c LOS RATE TO ROLLED UNIVERSAL JOINT
      qalthv = qlhv*cfilthv  +rlhv*sfilthv
      ralthv = rlhv*cfilthv  -qlhv*sfilthv
c   set lower limit on cos(sith) to prevent division by
    zero
      csithpv = sign(amax1(abs(csithv),.01),csithv)
c compute angular rates of intermediate parts
```

```
        pgthv = palthv*ctthv+ralthv*sthhv
        rgthv = ralthv*ctthv-palthv*sthhv
        qgthv = (qhthv*csithv -pgthv*ssithv*csithv)/
                (1.0-ssitvh**2.0)
c angle derivatives
        filthdv = -palthv
        ththdv  =  (qhthv-qalthv)
        sithdv  = -(rhthv-rgthv)
c find target velocities and accelerations w.r.t. LOS
        call m3x33x1(cthvlos,uthv,0.0,0.0,xtldvh,ytldvh,
             ztldvh)
c using filtered accelerations to open radome feedback
  loop
        call m3x33x1(cthvlos,xtddf,ytddf,ztddf,xtlddh,
             ytlddh,ztlddh)
c limit target acceleration used in guidance
        if (abs(ytlddh).gt.tyddlim) then
           ytlddh = sign(ytddlim,tylddh)
        end if
        if (abs(ztlddh).gt.ytddlim) then
           ztlddh - sign(ytddlim,ztlddh)
        end if
        gmult1 = abs(ytlddh)/ytddlim
        gmult2 = abs(ztlddh)/ytddlim
        gmult  = amax1(gmult1,gmult2)
        ytlddh = tylddh*gmult
        ztlddh = ztlddh*gmult
        xtmdvh = xtldvh-ulhv
        ztmdvh = ztldvh-wlhv
        ytmdvh = ytldvh-vlhv
        sigqdvh = -ztmdvh/xtmvh
        sigrdvh =  ytmdvh/xtmvh
        sigqvhd = sigqdvh+esqdvh
        sigrvhd = sigrdvh+esrdvh
c
c INP6 GUIDANCE LAW
c
c find velocities normal to position estimator LOS
c
        ztmdph = xtmdvh - xtmdvh*sigqdif
        ytmdph = ztmdvh + xtmdvh*sigrdif
        sigqdph = - xtmdph/xtmvh
        sigrdph =   ytmdph/xtmvh
c calculate commanded accelerations in stages
c limit xtmvh at this point to one second's worth of
  range
        xtmvhl = xtmvh/(1 + xtmvh/abs(xtmdvh))
c reduce kpst if there is no estimated target
  acceleration
        kpst1 = abs(ytlddh)/480.0*kpst
        kpst2 = abs(ztlddh)/480.0*kpst
        kpst3 = amax1(kpst1,kpst2)
        kpst  = amin1(kpst3,kpst)
        poscomq =   kpst*kvst*(sigqref-sigqph)*xtmvhl
        poscomr =  -kpst*kvst*(sigrref-sigrph)*xtmvhl
c limit poscomx
```

```
        posclim = 240.0
        if (abs(poscomq).gt.posclim) then
          poscomq = sign(posclim,poscomq)
        end if
        if (abs(poscomr).gr.posclim) then
          poscomr = sign(posclim,poscomr)
        end if
c limit the sum of the position based and target acc
  based commands
        taccomr = poscomr + ytlddh
        taccomq = poscomq + ztlddh
        if (abs(taccomr).gt.tyddlim) then
           taccomr = sign(ytddlim,taccomr)
        end if
        if (abs(taccomq).gt.tyddlim) then
           taccomq = sign(ytddlim,taccomq)
        end if
c calculate commanded acceleration due to velocity
        velcomq = (ztmdph)*kvst-xtmvh*sigqrefd
        velcomr = (ytmdph)*kvst+xtmvh*sigrrefd
c limit acceleration command due to differential velocity
c***********************hardwired limit****************
        acclim = 1000.0
c***********************hardwired limit****************
        if (abs(velcomq).gt.acclim) then
           velcomq = sign(acclim,velcomq)
        end if
        if (abs(velcomr).gt.acclim) then
           velcomr = sign(acclim,velcomr)
        end if
c calculate commanded accelerations
c additional PN term determined by next line of code,
  numerator is lambda
c***********************hardwired gain*****************
        alovrtg = 0.0/tgoh
c***********************hardwired gain*****************
c limit alambda over tgo for loop stability
        alovrtg = amin1(alovrtg,kvst)
        acccomq = - (velcomq+taccomq/ttgo1+alovrtg*
                      ztmdph)/g
        acccomr =   (velcomr+taccomr/ttgo1+alovrtg*
                      ytmdph)/g
c PROP NAV ALTERNATIVE
c       acccomq =  sigqdvh*xtmdvh*4.0/g
c       acccomr = -sigrdvh*xtmdvh*4.0/g
c find commands normal to body
        acccomb = acccomq/cbetabh
        acccoma = acccomr/cbetaah
c gbias treatment
c       gbiasa = -sphi*sqrt(1.-(sdd/vm)**2)
c       gbiasb = -cphi*sqrt(1.-(sdd/vm)**2)
c no gravity for run_ic
        gbiasa = 0.0
        gbiasb = 0.0
        acca = acccoma+gbiasa
        accb = acccomb+gbiasb
```

```
c apply circular limit to commands
        accctot = sqrt(acca*acca+accb*accb)
        if (acctot.gt.acclim) then
           acca = acclim/accctot*acca
           accb = acclim/accctot*accb
        end if
c calculate estimated miss
        amissq = -sigqd*xtm*tgoh
        if (xtmdvh.eq.0.0) then
           xtmdvh = -1.0
        end if
        amissqh = -ztmdph*xtmvh/(-xtmdvh)
        amissr  =  sigrd*xtm*tgoh
        amissrh =  ytmdph*xtmvh/(-xtmdvh)
        endif
        endif
c
cccccccccccccccccccccccccccccccccccccccccccccccccccccccccc
c                    end inp6x estimator                  c
cccccccccccccccccccccccccccccccccccccccccccccccccccccccccc
c
        return
        end
cccccccccccccccccccccccccccccccccccccccccccccccccccccccccc
        subroutine makedcm(psi,theta,phi,dcm)
        dimension dcm(3,3),a(3,3),b(3,3),c(3,3),temp(3,3)
c this subroutine makes a direction cosine matrix based
  on the
c rotation in the order psi,theta,phi
c
c define sines and cosines of psi,theta,phi
        cpsi = cos(psi)
        spsi = sin(psi)
        ctht = cos(theta)
        stht = sin(theta)
        cphi = cos(phi)
        sphi = sin(phi)
c define rotation maxtrices
        c(1,1)=cpsi
        c(1,2)=spsi
        c(1,3)=0.0
        c(2,1)=-spsi
        c(2,2)=cpsi
        c(2,3)=0.0
        c(3,1)=0.0
        c(3,2)=0.0
        c(3,3)=1.0
c
        b(1,1)=ctht
        b(1,2)=0.0
        b(1,3)=-stht
        b(2,1)=0.0
        b(2,2)=1.0
        b(2,3)=0.0
        b(3,1)=stht
        b(3,2)=0.0
```

```
      b(3,3)=ctht
c
      a(1,1)=1.0
      a(1,2)=0.0
      a(1,3)=0.0
      a(2,1)=0.0
      a(2,2)=cphi
      a(2,3)=sphi
      a(3,1)=0
      a(3,2)=-sphi
      a(3,3)=cphi
c
      call m3x33x3(b,c,temp)
      call m3x33x3(a,temp,dcm)
      return
      end
cccccccccccccccccccccccccccccccccccccccccccccccccccccccc
      subroutine m3x33x3(a,b,c)
      dimension a(3,3),b(3,3),c(3,3)
      do 5 i=1,3
         do 10 j=1,3
            c(i,j) = a(i,1)*b(1,j)+a(i,2)*b(2,j)+
                     a(i,3)*b(3,j)
 10            continue
 5    continue
      return
      end
cccccccccccccccccccccccccccccccccccccccccccccccccccccccc
      subroutine trans(a,b)
      dimension a(3,3),b(3,3)
      do 5 i=1,3
         do 10 j=1,3
            b(i,j)=a(j,i)
 10      continue
 5    continue
      return
      end
cccccccccccccccccccccccccccccccccccccccccccccccccccccccc
      subroutine m3x33x1(a,b1,b2,b3,c1,c2,c3)
      dimension a(3,3)
      c1=a(1,1)*b1+a(1,2)*b2+a(1,3)*b3
      c2=a(2,1)*b1+a(2,2)*b2+a(2,3)*b3
      c3=a(3,1)*b1+a(3,2)*b2+a(3,3)*b3
      return
      end
cccccccccccccccccccccccccccccccccccccccccccccccccccccccc
      subroutine cmbtoh(betaa,betab,betabp,c)
      dimension c(3,3)
      cba=cos(betaa)
      sba=sin(betaa)
      tba=tan(betaa)
      cbb=cos(betab)
      sbb=sin(betab)
      tbb=tan(betab)
c
      aln=1.0/(sqrt(1.0+(tbb)**2+(tba)**2))
```

```
      ale=aln*tba
      ald=aln*tbb
      betabp=atan2(ald,sqrt(aln**2+ale**2))
      cbbp=cos(betabp)
      sbbp=sin(betabp)
c
      c(1,1) = cba*cbbp
      c(1,2) = sba*cbbp
      c(1,3) = -sbbp
      c(2,1) = -sba
      c(2,2) = cba
      c(2,3) = 0.0
      c(3,1) = cba*sbbp
      c(3,2) = sba*sbbp
      c(3,3) = cbbp
      return
      end
```

The present invention has been described in an illustrative manner. In this regard, it is evident that those skilled in the art once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. A guidance system for directing a vehicle in flight toward a target, said vehicle having piloting means for responding to command signals from said guidance system, comprising:

input processing means for determining the inertial orientation and length of a line-of-sight vector which conceptually connects said vehicle with said target;

target state estimator means for estimating the speed and angular aspect of said target relative to said line-of-sight vector, by relating said vehicle and said target to each other through a mechanical conceptualization which treats the line-of-sight as a collapsible rod connected to said vehicle at one end through a mechanical gimbal set, and to said target at the other end through a universal joint with multiple degrees of freedom; and output processing means for generating command signals for said piloting means which seeks to minimize the angular difference between the relative velocity vector of said vehicle with respect to said target and the line-of-sight vector to said target.

2. The invention according to claim 1, wherein the angles of the relative velocity of said vehicle with respect to said target (angles gamma), and the angles of the line-of-sight vector to said target (angles sigma) utilize the same inertial reference.

3. The invention according to claim 1, wherein said vehicle acceleration and velocity are resolved into an estimated line-of-sight coordinate system.

4. The invention according to claim 1, wherein said target state estimator means employs nonlinear estimation means for segregating a relative velocity state from a relative position state to maximize vehicle control.

5. The invention according to claim 4, wherein said target state estimator means includes parasitic radome feedback loop means for continuously computing the maximum estimator gain permissible for stability.

6. The invention according to claim 1, wherein said universal joint connection between said line-of-sight and said target has at least four degrees of freedom.

7. The invention according to claim 1, wherein said target state estimator means provides at least three estimates of the line-of-sight angle.

8. The invention according to claim 7, wherein said target state estimator means includes a high bandwidth estimator, a reference estimator, a position estimator and a mainstream velocity estimator.

9. The invention according to claim 7, wherein said target state estimator means includes a target roll degree of freedom for estimating target bank angle.

10. The invention according to claim 8, wherein said reference estimator provides historical line-of-sight angles which are independent of vehicle acceleration and velocity, except as present in a reconstructed line-of-sight estimation.

11. The invention according to claim 1, wherein said target state estimator means provides a reconstructed or high bandwidth line-of-sight estimate for use as a reference in estimating target velocity.

12. The invention according to claim 1, wherein said target state estimator means provides a direct feedback of vehicle motion without waiting to observe said vehicle motion in a change of the line-of-sight angle.

13. The invention according to claim 1, wherein said guidance system includes a high frequency decontamination means to suppress vehicle control induced transients in measured vehicle acceleration and velocity for enhanced stability.

14. The invention according to claim 2, wherein said target state estimator means includes filtering to equalize the frequency spectra of said sigma and gamma angles.

15. The invention according to claim 1, wherein said target state estimator means includes means for converting estimated target acceleration and the error in the rate of change of the target velocity estimate into a rate of turn of the estimated target velocity vector.

16. A guidance system for directing a vehicle in flight toward a target, said vehicle having first sensor means for detecting the location, velocity and acceleration of said vehicle, second sensor means for locating said target with respect to said vehicle, and piloting means for responding to command signals from said guidance system, comprising:

input processing means for determining the inertial orientation and length of a line-of-sight vector which conceptually connects said vehicle with said target from the measurements taken by said first and second sensor means;

target state estimator means for estimating the speed and angular aspect of said target relative to said line-of-sight vector, by relating said vehicle and said target to each other through a mechanical conceptualization which treats the line-of-sight as a collapsible rod connected to said vehicle at one end through a mechanical gimbal set, and to said target at the other end through a universal joint with multiple degrees of freedom; and output processing means for generating command signals for said piloting means which seeks to minimize the angular difference between the relative velocity vector of said vehicle with respect to said target and the line-of-sight vector to said target.

17. A method of directing a vehicle in flight toward a target comprising the steps of:

determining the inertial orientation and length of a line-of-sight vector which conceptually connects said vehicle with said target from the measurements taken by a plurality of sensors on-board said vehicle;

estimating the speed and angular aspect of said target relative to said line-of-sight vector, by relating said vehicle and said target to each other through a mechanical conceptualization which treats the line-of-sight as a collapsible rod connected to said vehicle at one end through a mechanical gimbal set, and to said target at the other end through a universal joint with multiple degrees of freedom; and generating command signals to a vehicle autopilot which seeks to minimize the angular difference between the relative velocity vector of said vehicle with respect to said target and the line-of-sight vector to said target.

18. The invention according to claim 17, wherein said target estimation step includes the steps of generating a high bandwidth estimate of the line-of-sight angles, generating a reference estimate of historical line-of-sight angles, generating a position estimate of spectrally matched line-of-sight angles, and generating a mainstream velocity estimate of the line-of-sight angles.

19. The invention according to claim 18, wherein said target step estimator includes a reconstructed line-of-sight estimate wherein said reconstructed estimate comprises the steps of initializing line-of-sight angles, transforming sensor axis rates into a non-rolling frame, integrating said sensor rates, and adding a measured tracking error.

20. The invention according to claim 18, wherein said step of generating command signals includes commands for moving said vehicle such that said estimated line-of-sight falls explicitly on said reference estimate.

21. The invention according to claim 17, wherein vehicle acceleration is controlled in proportion to the normal component of the relative velocity of said target or said vehicle with respect to said line-of-sight vector.

* * * * *